US008106854B2

(12) United States Patent
Chui

(10) Patent No.: US 8,106,854 B2
(45) Date of Patent: Jan. 31, 2012

(54) COMPOSITE DISPLAY

(75) Inventor: Clarence Chui, San Jose, CA (US)

(73) Assignee: Qualcomm Mems Technologies, Inc., San Diego, CA (US)

( * ) Notice: Subject to any disclaimer, the term of this patent is extended or adjusted under 35 U.S.C. 154(b) by 897 days.

(21) Appl. No.: 12/008,711

(22) Filed: Jan. 10, 2008

(65) Prior Publication Data

US 2009/0002272 A1 Jan. 1, 2009

Related U.S. Application Data

(60) Provisional application No. 60/966,549, filed on Jun. 28, 2007.

(51) Int. Cl.
*G09G 3/00* (2006.01)

(52) U.S. Cl. ..... 345/31; 345/30; 345/32

(58) Field of Classification Search ..... 345/110, 345/418, 690, 1.3, 4, 30–33, 46, 82–87, 182–184, 345/581, 619; 348/743, 758, 51; 349/18.64; 352/107, 112, 115, 118; 362/249.02
See application file for complete search history.

(56) References Cited

U.S. PATENT DOCUMENTS

| | | | | | |
|---|---|---|---|---|---|
| 1,725,851 | A | * | 8/1929 | Craig | 40/435 |
| 2,036,147 | A | * | 3/1936 | Klema | 40/470 |
| 2,951,617 | A | | 9/1960 | Brock | |
| 3,246,410 | A | * | 4/1966 | Festa | 40/472 |
| 3,465,586 | A | | 9/1969 | Johnston | |
| 4,160,973 | A | * | 7/1979 | Berlin, Jr. | 345/31 |
| 4,298,868 | A | | 11/1981 | Spurgeon | |
| 4,311,999 | A | | 1/1982 | Upton et al. | |
| 4,689,604 | A | | 8/1987 | Sokol | |
| 5,057,827 | A | | 10/1991 | Nobile et al. | |
| 5,101,439 | A | | 3/1992 | Kiang | |
| 5,115,229 | A | | 5/1992 | Shalit | |
| 5,190,491 | A | * | 3/1993 | Connelly | 446/242 |
| 5,444,456 | A | | 8/1995 | Ohta et al. | |
| 5,576,761 | A | | 11/1996 | Iwamoto | |
| 5,717,416 | A | * | 2/1998 | Chakrabarti | 345/31 |
| 5,748,157 | A | | 5/1998 | Eason | |
| 5,791,966 | A | | 8/1998 | Capps et al. | |
| 5,800,039 | A | | 9/1998 | Lee | |
| 5,864,331 | A | | 1/1999 | Anand et al. | |

(Continued)

FOREIGN PATENT DOCUMENTS

CN 102187679 9/2011

(Continued)

OTHER PUBLICATIONS

An Analog & Digital propeller clock I made! It isn't Real its just because your so awfully slow!!!;-) 1997 Bob Blick pp. 1-26 http://www.luberth.com/analog.htm.

(Continued)

*Primary Examiner* — Prabodh M Dharia
(74) *Attorney, Agent, or Firm* — Weaver Austin Villeneuve & Sampson LLP

(57) ABSTRACT

A composite display may include a compound paddle having a plurality of components and configured to sweep out an area. A plurality of pixel elements may be mounted on at least one component of the plurality of components. Selectively activating one or more of the plurality of pixel elements while the compound paddle sweeps the area causes can cause at least a portion of an image to be rendered.

25 Claims, 28 Drawing Sheets

U.S. PATENT DOCUMENTS 5,886,728 A * 3/1999 Hamada et al. ..... 347/242
5,959,617 A * 9/1999 Bird et al. ..... 345/182
5,990,498 A 11/1999 Chapnik et al.
5,992,498 A * 11/1999 Boston ..... 160/370.22
6,037,876 A * 3/2000 Crouch ..... 340/815.53
6,116,762 A 9/2000 Kutlucinar
6,193,384 B1 * 2/2001 Stein ..... 362/96
6,243,059 B1 6/2001 Greene et al.
6,243,149 B1 6/2001 Swanson et al.
6,249,998 B1 * 6/2001 NakaMats ..... 40/452
6,265,984 B1 7/2001 Molinaroli
6,275,615 B1 8/2001 Ida et al.
6,320,325 B1 11/2001 Cok et al.
6,404,409 B1 6/2002 Solomon
6,475,153 B1 11/2002 Khair et al.
6,492,963 B1 12/2002 Hoch
6,508,022 B2 1/2003 Huang
6,525,668 B1 2/2003 Petrick
6,575,585 B2 6/2003 Nelson et al.
6,697,034 B2 * 2/2004 Tashman ..... 345/31
6,856,303 B2 2/2005 Kowalewski
6,928,137 B2 8/2005 Bruder et al.
6,955,449 B2 10/2005 Martineau
7,027,054 B1 4/2006 Cheiky et al.
7,033,035 B2 4/2006 Fatemi et al.
7,082,591 B2 7/2006 Carlson
7,101,153 B2 * 9/2006 Cartwright ..... 416/62
7,113,165 B2 9/2006 Vincent et al.
7,164,810 B2 * 1/2007 Schnee et al. ..... 382/313
7,175,305 B2 2/2007 Martineau
7,237,924 B2 7/2007 Martineau et al.
7,267,444 B2 9/2007 Black, Jr.
7,271,813 B2 * 9/2007 Gilbert ..... 345/619
7,397,387 B2 7/2008 Suzuki et al.
7,553,051 B2 6/2009 Brass et al.
7,703,946 B2 4/2010 Chiang et al.
7,714,923 B2 5/2010 Cok et al.
7,758,214 B2 7/2010 Lee et al.
7,837,358 B2 11/2010 Liao
7,871,192 B2 1/2011 Chien
7,872,631 B2 1/2011 Feng et al.
7,911,411 B2 * 3/2011 Yoshikawa et al. ..... 345/32
2001/0023547 A1 9/2001 Huang
2001/0048406 A1 12/2001 Masumoto et al.
2002/0005826 A1 * 1/2002 Pederson ..... 345/82
2002/0140631 A1 * 10/2002 Blundell ..... 345/4
2002/0176625 A1 11/2002 Porikli et al.
2003/0160739 A1 * 8/2003 Silic ..... 345/30
2003/0164807 A1 9/2003 Glatzer
2003/0184513 A1 10/2003 Janssen
2003/0218881 A1 11/2003 Hansen et al.
2004/0102223 A1 5/2004 Lo et al.
2004/0105256 A1 6/2004 Jones
2004/0105573 A1 6/2004 Neumann et al.
2004/0114714 A1 6/2004 Minyard et al.
2004/0140981 A1 7/2004 Clark
2004/0141581 A1 7/2004 Bruder et al.
2004/0188687 A1 9/2004 Arnold et al.
2004/0196225 A1 10/2004 Shimada
2004/0262393 A1 12/2004 Hara et al.
2005/0030305 A1 2/2005 Brown et al.
2005/0052404 A1 3/2005 Kim et al.
2005/0110728 A1 5/2005 Cok
2005/0174780 A1 8/2005 Park
2005/0237272 A1 * 10/2005 Josephson et al. ..... 345/46
2005/0264472 A1 * 12/2005 Rast ..... 345/30
2006/0001384 A1 1/2006 Tain et al.
2006/0006524 A1 1/2006 Hsieh
2006/0007011 A1 1/2006 Chivarov
2006/0007206 A1 1/2006 Reddy et al.
2006/0038831 A1 * 2/2006 Gilbert ..... 345/619
2006/0081869 A1 4/2006 Lu et al.
2006/0092639 A1 5/2006 Livesay et al.
2006/0119592 A1 6/2006 Wang et al.
2006/0152524 A1 7/2006 Miller et al.
2006/0244741 A1 11/2006 Kimura et al.
2006/0274286 A1 12/2006 Morejon et al.
2007/0035707 A1 * 2/2007 Margulis ..... 353/122
2007/0046924 A1 3/2007 Chang
2007/0177817 A1 8/2007 Szeliski et al.
2008/0062161 A1 3/2008 Brown
2008/0068297 A1 * 3/2008 Gilbert ..... 345/31
2008/0068799 A1 3/2008 Chan
2008/0106628 A1 5/2008 Cok et al.
2008/0222932 A1 9/2008 Yun et al.
2008/0253125 A1 10/2008 Kang et al.
2008/0303747 A1 * 12/2008 Velicescu ..... 345/1.3
2009/0002270 A1 1/2009 Chui
2009/0002271 A1 1/2009 Chui
2009/0002272 A1 * 1/2009 Chui ..... 345/31
2009/0002273 A1 1/2009 Chui
2009/0002288 A1 1/2009 Chui
2009/0002289 A1 1/2009 Chui
2009/0002290 A1 1/2009 Chui
2009/0002293 A1 * 1/2009 Chui ..... 345/87
2009/0002362 A1 1/2009 Chui
2009/0104969 A1 * 4/2009 Paulsen et al. ..... 463/20
2009/0115794 A1 * 5/2009 Fukuta ..... 345/581
2009/0323341 A1 12/2009 Chui
2010/0019993 A1 1/2010 Chui
2010/0019997 A1 1/2010 Chui
2010/0020107 A1 1/2010 Chui
2010/0097448 A1 * 4/2010 Gilbert et al. ..... 348/51
2010/0301372 A1 12/2010 Loh

FOREIGN PATENT DOCUMENTS

DE 102006030890 5/2007
EP 1335430 8/2003
EP 2167999 3/2010
EP 2342899 7/2011
EP 2390867 11/2011
EP 2395499 12/2011
JP 2006-252777 9/2006
TW 200917179 4/2009
WO 00/17843 3/2000
WO 03/021565 3/2003
WO 03/077013 9/2003
WO 2006/021788 3/2006
WO 2004/097783 11/2007
WO 2009005754 1/2009
WO 2009005756 1/2009
WO 2009005757 1/2009
WO 2009005762 1/2009
WO 2010011303 1/2010

OTHER PUBLICATIONS

SpaceWriter, Lighting Kinetics, FanScreen Jul. 25, 2002: http://web.archive.org/web/20020725092751/http:/www.spacewriter.com/.

SpaceWriter, WallScreen, Dec. 7, 2003: http://web.archive.org/web/20031207125205/www.spacewriter.com/wallscreen.asp?menuproduct=WS.

U.S. Office Action mailed Sep. 17, 2010, from U.S. Appl. No. 11/906,770.

U.S. Final Office Action mailed Apr. 12, 2011, from U.S. Appl. No. 11/906,770.

U.S. Office Action mailed Sep. 28, 2010, from U.S. Appl. No. 11/906,772.

U.S. Final Office Action mailed Apr. 12, 2011, from U.S. Appl. No. 11/906,772.

U.S. Office Action mailed Sep. 23, 2010, from U.S. Appl. No. 11/906,773.

U.S. Final Office Action mailed Apr. 26, 2011, from U.S. Appl. No. 11/906,773.

U.S. Office Action mailed Sep. 28, 2010, from U.S. Appl. No. 11/906,774.

U.S. Final Office Action mailed Mar. 29, 2011, from U.S. Appl. No. 11/906,774.

U.S. Office Action mailed Sep. 3, 2010, from U.S. Appl. No. 11/906,775.

U.S. Office Action mailed Jan. 31, 2011, from U.S. Appl. No. 12/008,700.

U.S. Office Action mailed Feb. 14, 2011, from U.S. Appl. No. 12/008,712.

U.S. Office Action mailed Dec. 6, 2010, from U.S. Appl. No. 12/099,843.
U.S. Office Action mailed Apr. 4, 2011, from U.S. Appl. No. 12/380,588.
International Search Report and Written Opinion mailed Oct. 7, 2008, from Application No. PCT/US2008/008111.
International Preliminary Report on Patentability mailed Jan. 5, 2010, from Application No. PCT/US2008/008111.
International Search Report and Written Opinion mailed Sep. 29, 2008, from Application No. PCT/US2008/008102.
International Preliminary Report on Patentability mailed Jan. 5, 2010, from Application No. PCT/US2008/008102.
International Search Report and Written Opinion mailed Oct. 7, 2008, from Application No. PCT/US2008/008106.
International Preliminary Report on Patentability mailed Jan. 5, 2010, from Application No. PCT/US2008/008106.
International Search Report and Written Opinion mailed Oct. 1, 2008, from Application No. PCT/US2008/008098.
International Preliminary Report on Patentability mailed Jan. 5, 2010, from Application No. PCT/US2008/008098.
International Search Report and Written Opinion mailed Nov. 16, 2009, from Application No. PCT/US2009/004245.
International Preliminary Report on Patentability mailed Jan. 25, 2011, from Application No. PCT/US2009/004245.
U.S. Notice of Allowance mailed Aug. 19, 2011, from U.S. Appl. No. 11/906,770.
U.S. Final Office Action mailed May 12, 2011, from U.S. Appl. No. 11/906,775.
U.S. Advisory Action mailed Jul. 26, 2011, from U.S. Appl. No. 11/906,775.
U.S. Office Action mailed Jun. 2, 2011, from U.S. Appl. No. 12/008,700.
U.S. Final Office Action mailed Jun. 15, 2011, from U.S. Appl. No. 12/008,712.
U.S. Notice of Allowance mailed May 31, 2011, from U.S. Appl. No. 12/009,843.
U.S. Office Action mailed Jul. 5, 2011, from U.S. Appl. No. 12/099,843.
U.S. Office Action mailed May 26, 2011, from U.S. Appl. No. 12/220,443.
U.S. Office Action mailed Jun. 15, 2011, from U.S. Appl. No. 12/220,444.
U.S. Office Action mailed Jun. 9, 2011, from U.S. Appl. No. 12/220,447.
U.S. Final Office Action mailed Aug. 22, 2011, from U.S. Appl. No. 12/380,588.
U.S. Office Action mailed Oct. 13, 2011, from U.S. Appl. No. 11/906,774.
U.S. Notice of Allowance mailed Oct. 20, 2011, from U.S. Appl. No. 12/008,700.
U.S. Office Action mailed Sep. 29, 2011, from U.S. Appl. No. 12/008,712.
U.S. Final Office Action mailed Oct. 24, 2011, from U.S. Appl. No. 12/220,443.
U.S. Final Office Action mailed Oct. 21, 2011, from U.S. Appl. No. 12/220,444.
U.S. Final Office Action mailed Oct. 17, 2011, from U.S. Appl. No. 12/220,447.
European Extended Search Report mailed Nov. 15, 2011, from Application No. 11164990.1-2205.
European Extended Search Report mailed Nov. 2, 2011, from Application No. 11164973.7-2205.

* cited by examiner

COMPOSITE DISPLAY

CROSS REFERENCE TO OTHER APPLICATIONS

This application claims priority to U.S. Provisional Patent Application No. 60/966,549 entitled COMPOSITE DISPLAY filed Jun. 28, 2007, which is incorporated herein by reference for all purposes.

BACKGROUND OF THE INVENTION

Digital displays are used to display images or video to provide advertising or other information. For example, digital displays may be used in billboards, bulletins, posters, highway signs, and stadium displays. Digital displays that use liquid crystal display (LCD) or plasma technologies are limited in size because of size limits of the glass panels associated with these technologies. Larger digital displays typically comprise a grid of printed circuit board (PCB) tiles, where each tile is populated with packaged light emitting diodes (LEDs). Because of the space required by the LEDs, the resolution of these displays is relatively coarse. Also, each LED corresponds to a pixel in the image, which can be expensive for large displays. In addition, a complex cooling system is typically used to sink heat generated by the LEDs, which may burn out at high temperatures. As such, improvements to digital display technology are needed.

BRIEF DESCRIPTION OF THE DRAWINGS

Various embodiments of the invention are disclosed in the following detailed description and the accompanying drawings.

DETAILED DESCRIPTION

The invention can be implemented in numerous ways, including as a process, an apparatus, a system, a composition of matter, a computer readable medium such as a computer readable storage medium or a computer network wherein program instructions are sent over optical or communication links. In this specification, these implementations, or any other form that the invention may take, may be referred to as techniques. A component such as a processor or a memory described as being configured to perform a task includes both a general component that is temporarily configured to perform the task at a given time or a specific component that is manufactured to perform the task. In general, the order of the steps of disclosed processes may be altered within the scope of the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Figure 1:
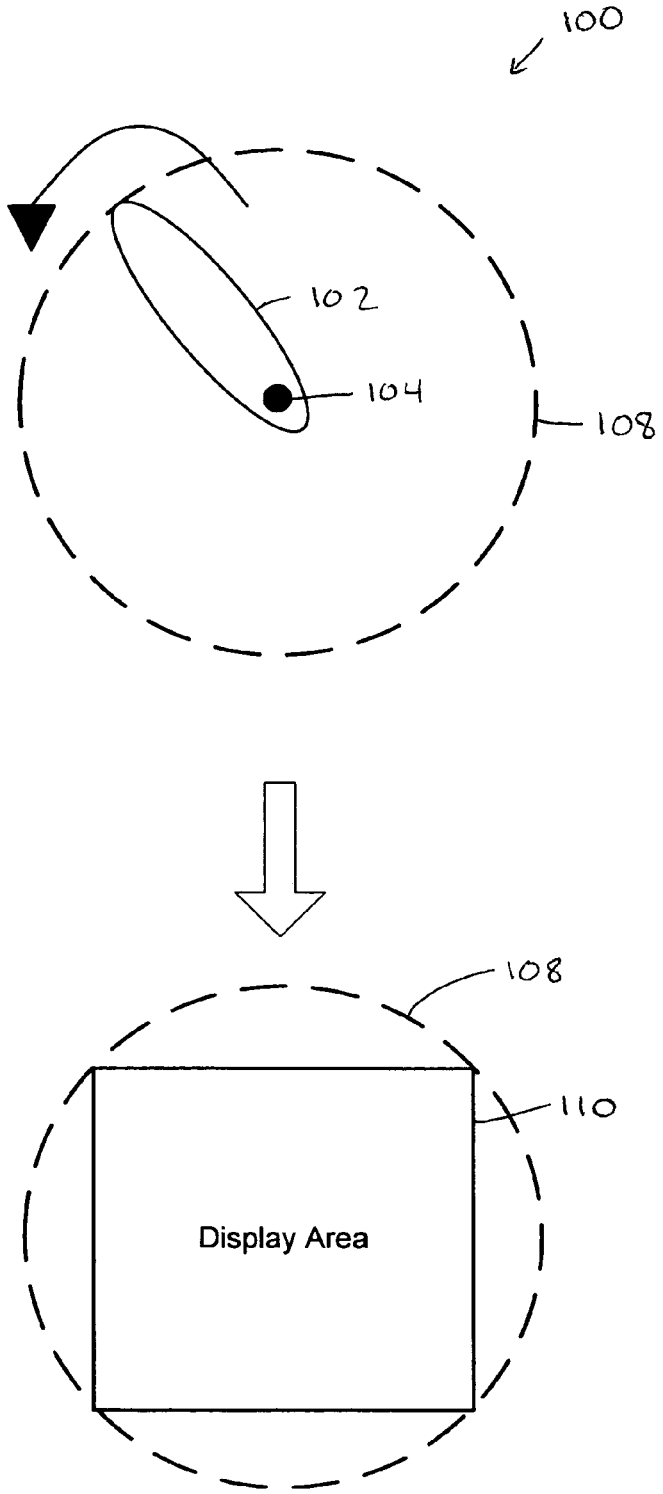
FIG. 1 is a diagram illustrating an embodiment of a composite display 100 having a single paddle.

FIG. 1 is a diagram illustrating an embodiment of a composite display 100 having a single paddle. In the example shown, paddle 102 is configured to rotate at one end about axis of rotation 104 at a given frequency, such as 60 Hz. Paddle 102 sweeps out area 108 during one rotation or paddle cycle. A plurality of pixel elements, such as LEDs, is installed on paddle 102. As used herein, a pixel element refers to any element that may be used to display at least a portion of image information. As used herein, image or image information may include image, video, animation, slideshow, or any other visual information that may be displayed. Other examples of pixel elements include: laser diodes, phosphors, cathode ray tubes, liquid crystal, any transmissive or emissive optical modulator. Although LEDs may be described in the examples herein, any appropriate pixel elements may be used. In various embodiments, LEDS may be arranged on paddle 102 in a variety of ways, as more fully described below.

As paddle 102 sweeps out area 108, one or more of its LEDs are activated at appropriate times such that an image or a part thereof is perceived by a viewer who is viewing swept area 108. An image is comprised of pixels each having a spatial location. It can be determined at which spatial location a particular LED is at any given point in time. As paddle 102 rotates, each LED can be activated as appropriate when its location coincides with a spatial location of a pixel in the image. If paddle 102 is spinning fast enough, the eye perceives a continuous image. This is because the eye has a poor frequency response to luminance and color information. The eye integrates color that it sees within a certain time window. If a few images are flashed in a fast sequence, the eye integrates that into a single continuous image. This low temporal sensitivity of the eye is referred to as persistence of vision.

As such, each LED on paddle 102 can be used to display multiple pixels in an image. A single pixel in an image is mapped to at least one "temporal pixel" in the display area in composite display 100. A temporal pixel can be defined by a pixel element on paddle 102 and a time (or angular position of the paddle), as more fully described below.

The display area for showing the image or video may have any shape. For example, the maximum display area is circular and is the same as swept area 108. A rectangular image or video may be displayed within swept area 108 in a rectangular display area 110 as shown.

Figure 2A:
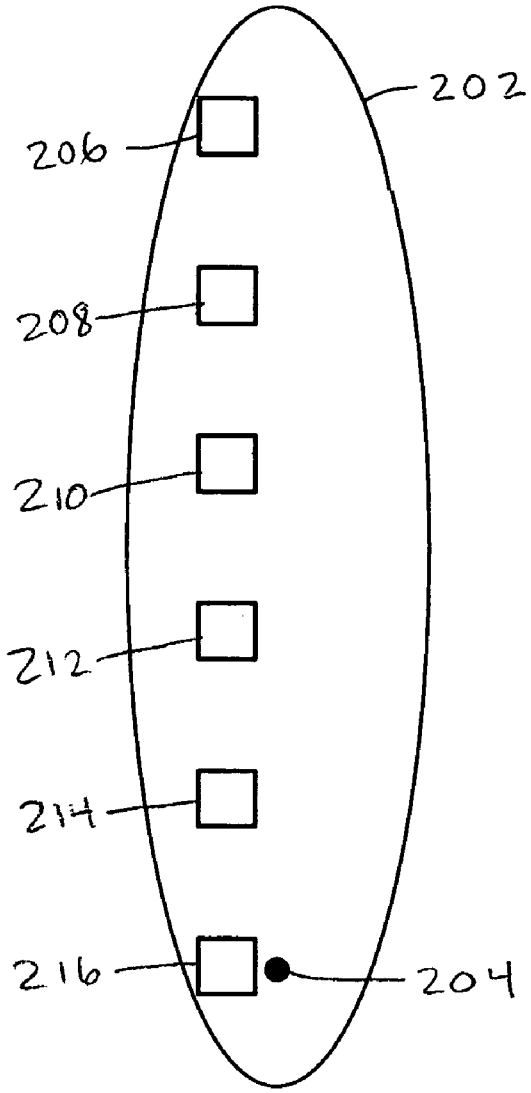
FIG. 2A is a diagram illustrating an embodiment of a paddle used in a composite display.

FIG. 2A is a diagram illustrating an embodiment of a paddle used in a composite display. For example, paddle 202, 302, or 312 (discussed later) may be similar to paddle 102. Paddle 202 is shown to include a plurality of LEDs 206-216 and an axis of rotation 204 about which paddle 202 rotates. LEDs 206-216 may be arranged in any appropriate way in various embodiments. In this example, LEDs 206-216 are arranged such that they are evenly spaced from each other and aligned along the length of paddle 202. They are aligned on the edge of paddle 202 so that LED 216 is adjacent to axis of rotation 204. This is so that as paddle 202 rotates, there is no blank spot in the middle (around axis of rotation 204). In some embodiments, paddle 202 is a PCB shaped like a paddle. In some embodiments, paddle 202 has an aluminum, metal, or other material casing for reinforcement.

Figure 2B:
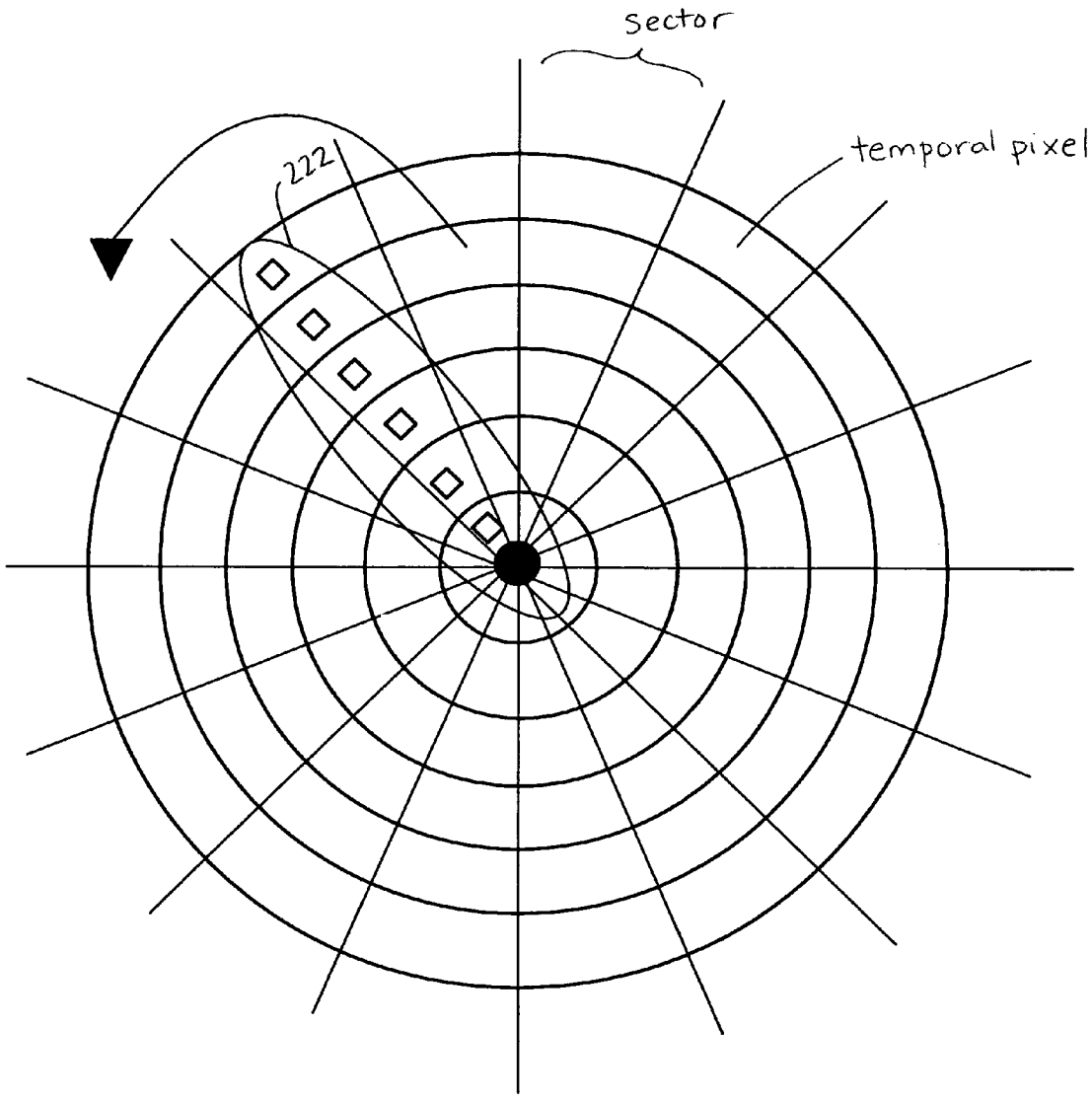
FIG. 2B illustrates an example of temporal pixels in a sweep plane.

FIG. 2B illustrates an example of temporal pixels in a sweep plane. In this example, each LED on paddle 222 is associated with an annulus (area between two circles) around the axis of rotation. Each LED can be activated once per sector (angular interval). Activating an LED may include, for example, turning on the LED for a prescribed time period (e.g., associated with a duty cycle) or turning off the LED. The intersections of the concentric circles and sectors form areas that correspond to temporal pixels. In this example, each temporal pixel has an angle of 42.5 degrees, so that there are a total of 16 sectors during which an LED may be turned on to indicate a pixel. Because there are 6 LEDs, there are 6*16=96 temporal pixels. In another example, a temporal pixel may have an angle of 1/10 of a degree, so that there are a total of 3600 angular positions possible.

Because the spacing of the LEDs along the paddle is uniform in the given example, temporal pixels get denser towards the center of the display (near the axis of rotation). Because image pixels are defined based on a rectangular coordinate system, if an image is overlaid on the display, one image pixel may correspond to multiple temporal pixels close to the center of the display. Conversely, at the outermost portion of the display, one image pixel may correspond to one or a fraction of a temporal pixel. For example, two or more image pixels may fit within a single temporal pixel. In some embodiments, the display is designed (e.g., by varying the sector time or the number/placement of LEDs on the paddle) so that at the outermost portion of the display, there is at least one temporal pixel per image pixel. This is to retain in the display the same level of resolution as the image. In some embodiments, the sector size is limited by how quickly LED control data can be transmitted to an LED driver to activate LED(s). In some embodiments, the arrangement of LEDs on the paddle is used to make the density of temporal pixels more uniform across the display. For example, LEDs may be placed closer together on the paddle the farther they are from the axis of rotation.

Figure 3:
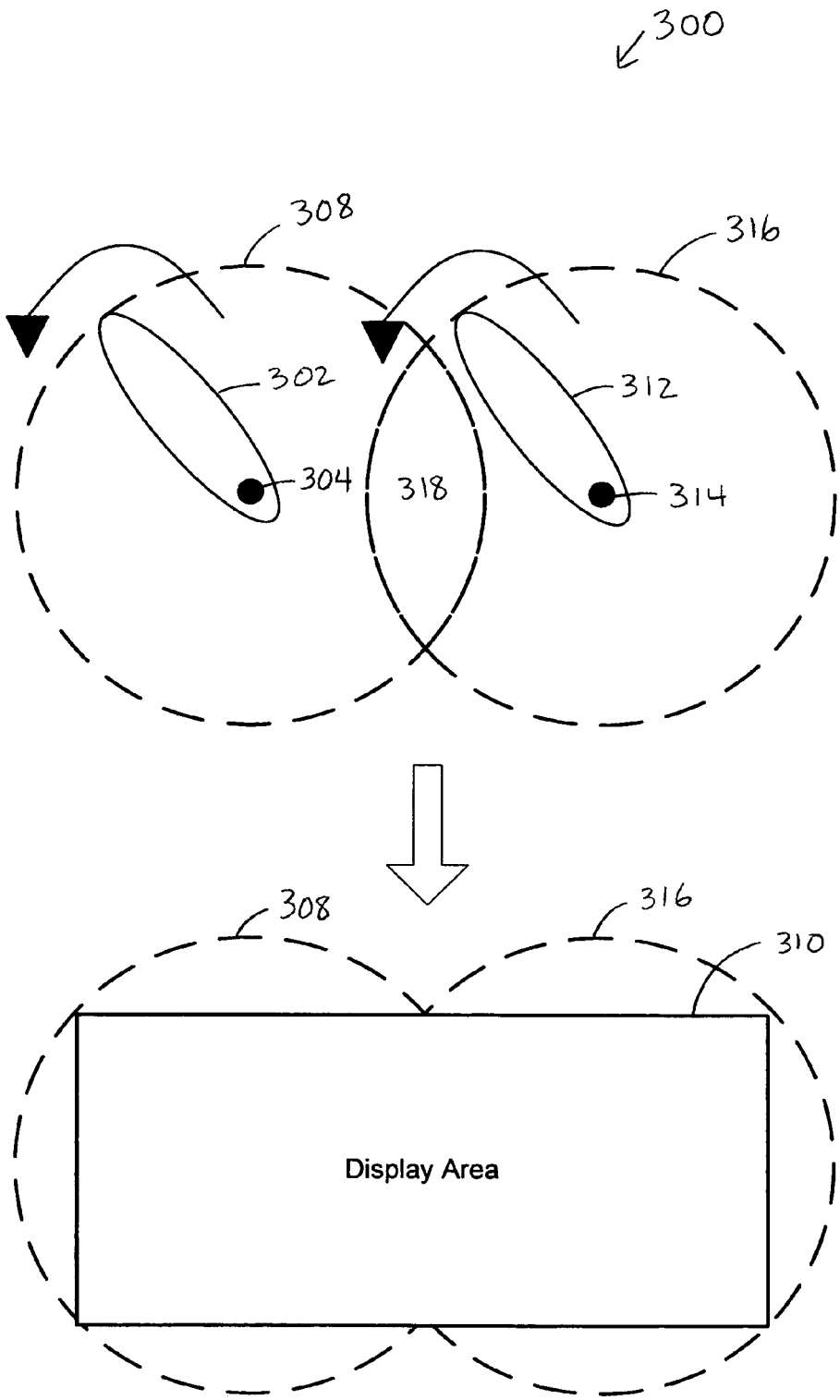
FIG. 3 is a diagram illustrating an embodiment of a composite display 300 having two paddles.

FIG. 3 is a diagram illustrating an embodiment of a composite display 300 having two paddles. In the example shown, paddle 302 is configured to rotate at one end about axis of rotation 304 at a given frequency, such as 60 Hz. Paddle 302 sweeps out area 308 during one rotation or paddle cycle. A plurality of pixel elements, such as LEDs, is installed on paddle 302. Paddle 312 is configured to rotate at one end about axis of rotation 314 at a given frequency, such as 60 Hz. Paddle 312 sweeps out area 316 during one rotation or paddle cycle. A plurality of pixel elements, such as LEDs, is installed on paddle 312. Swept areas 308 and 316 have an overlapping portion 318.

Using more than one paddle in a composite display may be desirable in order to make a larger display. For each paddle, it can be determined at which spatial location a particular LED is at any given point in time, so any image can be represented by a multiple paddle display in a manner similar to that described with respect to FIG. 1. In some embodiments, for overlapping portion 318, there will be twice as many LEDs passing through per cycle than in the nonoverlapping portions. This may make the overlapping portion of the display appear to the eye to have higher luminance. Therefore, in some embodiments, when an LED is in an overlapping portion, it may be activated half the time so that the whole display area appears to have the same luminance. This and other examples of handling overlapping areas are more fully described below.

The display area for showing the image or video may have any shape. The union of swept areas 308 and 316 is the maximum display area. A rectangular image or video may be displayed in rectangular display area 310 as shown.

Figure 4A:
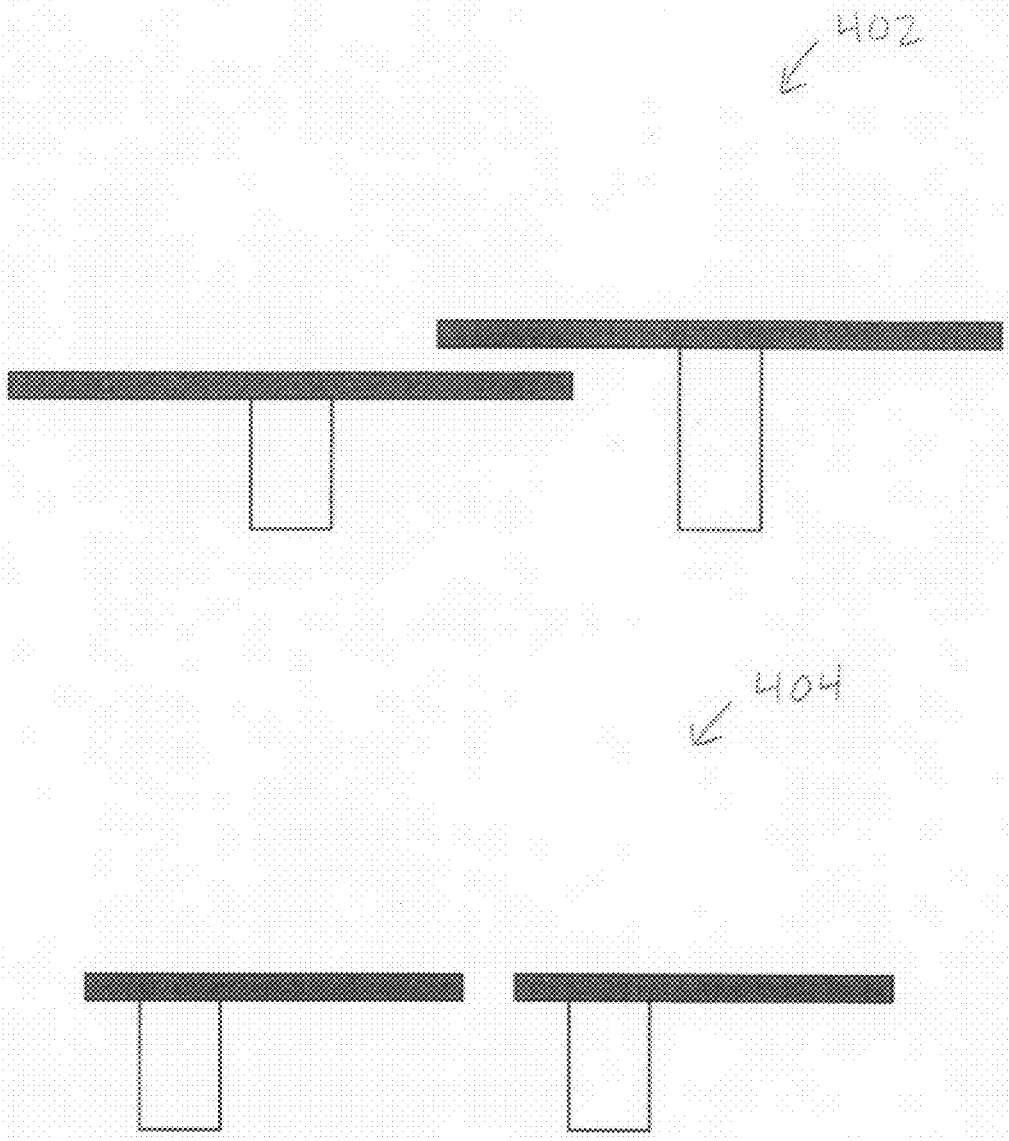
FIG. 4A illustrates examples of paddle installations in a composite display.

When using more than one paddle, there are various ways to ensure that adjacent paddles do not collide with each other. FIG. 4A illustrates examples of paddle installations in a composite display. In these examples, a cross section of adjacent paddles mounted on axes is shown.

In diagram 402, two adjacent paddles rotate in vertically separate sweep planes, ensuring that the paddles will not collide when rotating. This means that the two paddles can rotate at different speeds and do not need to be in phase with each other. To the eye, having the two paddles rotate in different sweep planes is not detectable if the resolution of the display is sufficiently smaller than the vertical spacing between the sweep planes. In this example, the axes are at the center of the paddles. This embodiment is more fully described below.

In diagram 404, the two paddles rotate in the same sweep plane. In this case, the rotation of the paddles is coordinated to avoid collision. For example, the paddles are rotated in phase with each other. Further examples of this are more fully described below.

In the case of the two paddles having different sweep planes, when viewing display area 310 from a point that is not normal to the center of display area 310, light may leak in diagonally between sweep planes. This may occur, for example, if the pixel elements emit unfocused light such that light is emitted at a range of angles. In some embodiments, a mask is used to block light from one sweep plane from being visible in another sweep plane. For example, a mask is placed behind paddle 302 and/or paddle 312. The mask may be attached to paddle 302 and/or 312 or stationary relative to paddle 302 and/or paddle 312. In some embodiments, paddle 302 and/or paddle 312 is shaped differently from that shown in FIGS. 3 and 4A, e.g., for masking purposes. For example, paddle 302 and/or paddle 312 may be shaped to mask the sweep area of the other paddle.

Figure 4B:
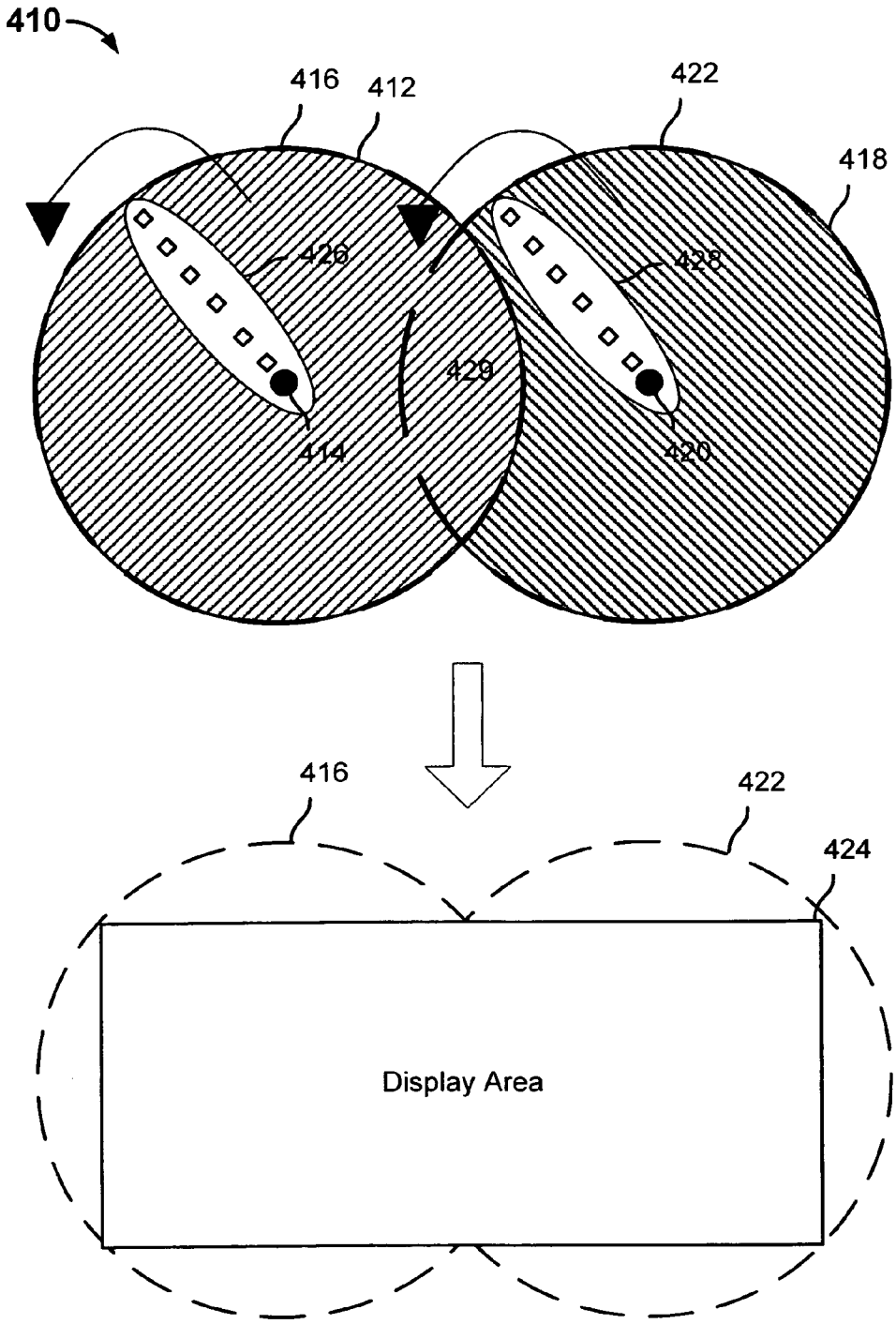
FIG. 4B is a diagram illustrating an embodiment of a composite display 410 that uses masks.

FIG. 4B is a diagram illustrating an embodiment of a composite display 410 that uses masks. In the example shown, paddle 426 is configured to rotate at one end about axis of rotation 414 at a given frequency, such as 60 Hz. A plurality of pixel elements, such as LEDs, is installed on paddle 426. Paddle 426 sweeps out area 416 (bold dashed line) during one rotation or paddle cycle. Paddle 428 is configured to rotate at one end about axis of rotation 420 at a given frequency, such as 60 Hz. Paddle 428 sweeps out area 422 (bold dashed line) during one rotation or paddle cycle. A plurality of pixel elements, such as LEDs, is installed on paddle 428.

In this example, mask 412 (solid line) is used behind paddle 426. In this case, mask 412 is the same shape as area 416 (i.e., a circle). Mask 412 masks light from pixel elements on paddle 428 from leaking into sweep area 416. Mask 412 may be installed behind paddle 426. In some embodiments, mask 412 is attached to paddle 426 and spins around axis of rotation 414 together with paddle 426. In some embodiments, mask 412 is installed behind paddle 426 and is stationary with respect to paddle 426. In this example, mask 418 (solid line) is similarly installed behind paddle 428.

In various embodiments, mask 412 and/or mask 418 may be made out of a variety of materials and have a variety of colors. For example, masks 412 and 418 may be black and made out of plastic.

The display area for showing the image or video may have any shape. The union of swept areas 416 and 422 is the maximum display area. A rectangular image or video may be displayed in rectangular display area 424 as shown.

Areas 416 and 422 overlap. As used herein, two elements (e.g., sweep area, sweep plane, mask, pixel element) overlap if they intersect in an x-y projection. In other words, if the areas are projected onto an x-y plane (defined by the x and y axes, where the x and y axes are in the plane of the figure), they intersect each other. Areas 416 and 422 do not sweep the same plane (do not have the same values of z, where the z axis is normal to the x and y axes), but they overlap each other in overlapping portion 429. In this example, mask 412 occludes sweep area 422 at overlapping portion 429 or occluded area 429. Mask 412 occludes sweep area 429 because it overlaps sweep area 429 and is on top of sweep area 429.

Figure 4C:
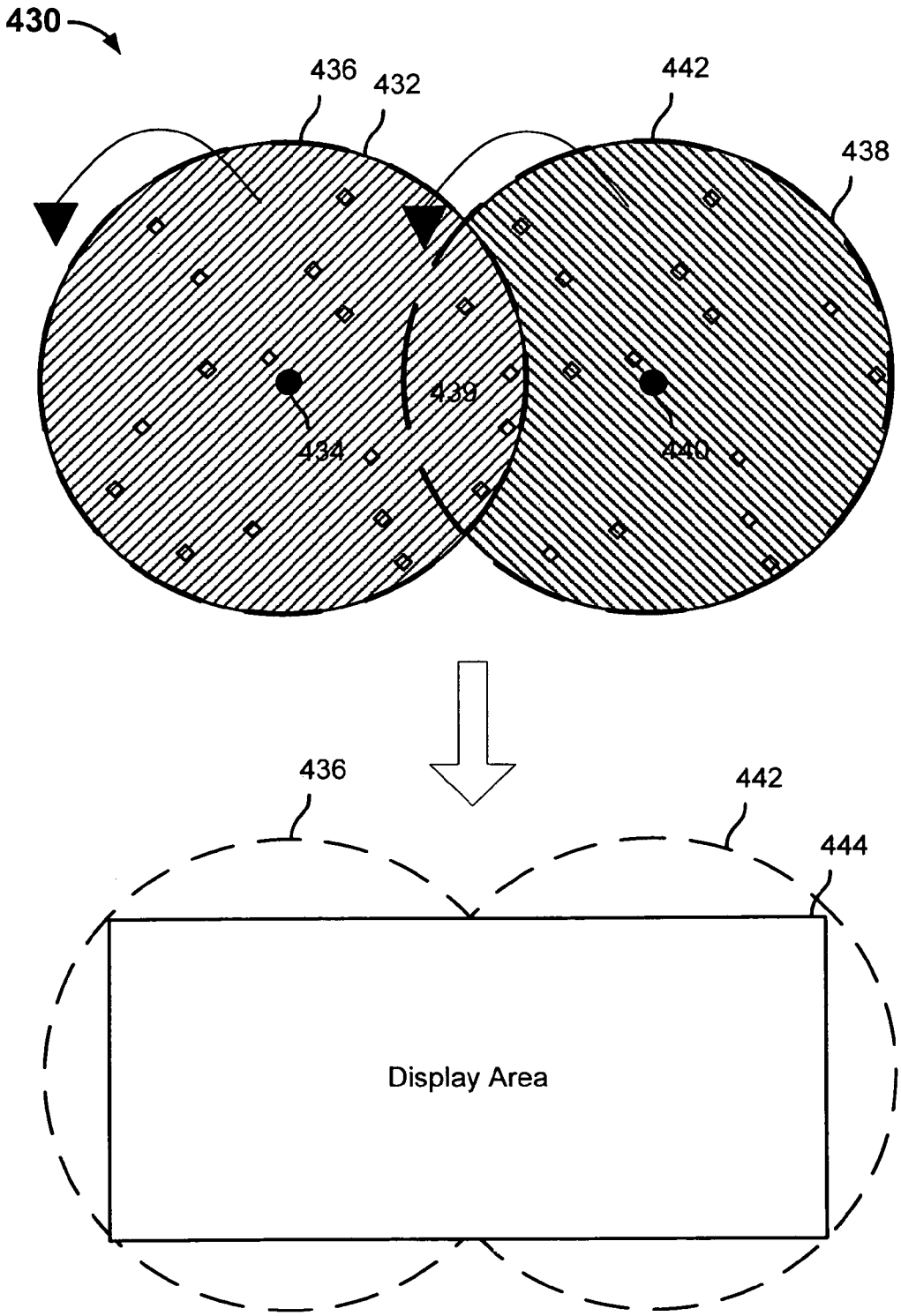
FIG. 4C is a diagram illustrating an embodiment of a composite display 430 that uses masks.

FIG. 4C is a diagram illustrating an embodiment of a composite display 430 that uses masks. In this example, pixel elements are attached to a rotating disc that functions as both a mask and a structure for the pixel elements. Disc 432 can be viewed as a circular shaped paddle. In the example shown, disc 432 (solid line) is configured to rotate at one end about axis of rotation 434 at a given frequency, such as 60 Hz. A plurality of pixel elements, such as LEDs, is installed on disc 432. Disc 432 sweeps out area 436 (bold dashed line) during one rotation or disc cycle. Disc 438 (solid line) is configured to rotate at one end about axis of rotation 440 at a given frequency, such as 60 Hz. Disc 438 sweeps out area 442 (bold dashed line) during one rotation or disc cycle. A plurality of pixel elements, such as LEDs, is installed on disc 438.

In this example, the pixel elements can be installed anywhere on discs 432 and 438. In some embodiments, pixel elements are installed on discs 432 and 438 in the same pattern. In other embodiments, different patterns are used on each disc. In some embodiments, the density of pixel elements is lower towards the center of each disc so the density of temporal pixels is more uniform than if the density of pixel elements is the same throughout the disc. In some embodiments, pixel elements are placed to provide redundancy of temporal pixels (i.e., more than one pixel is placed at the same radius). Having more pixel elements per pixel means that the rotation speed can be reduced. In some embodiments, pixel elements are placed to provide higher resolution of temporal pixels.

Disc 432 masks light from pixel elements on disc 438 from leaking into sweep area 436. In various embodiments, disc 432 and/or disc 438 may be made out of a variety of materials and have a variety of colors. For example, discs 432 and 438 may be black printed circuit board on which LEDs are installed.

The display area for showing the image or video may have any shape. The union of swept areas 436 and 442 is the maximum display area. A rectangular image or video may be displayed in rectangular display area 444 as shown.

Areas 436 and 442 overlap in overlapping portion 439. In this example, disc 432 occludes sweep area 442 at overlapping portion or occluded area 439.

In some embodiments, pixel elements are configured to not be activated when they are occluded. For example, the pixel elements installed on disc 438 are configured to not be activated when they are occluded, (e.g., overlap with occluded area 439). In some embodiments, the pixel elements are configured to not be activated in a portion of an occluded area. For example, an area within a certain distance from the edges of occluded area 439 is configured to not be activated. This may be desirable in case a viewer is to the left or right of the center of the display area and can see edge portions of the occluded area.

Figure 5:
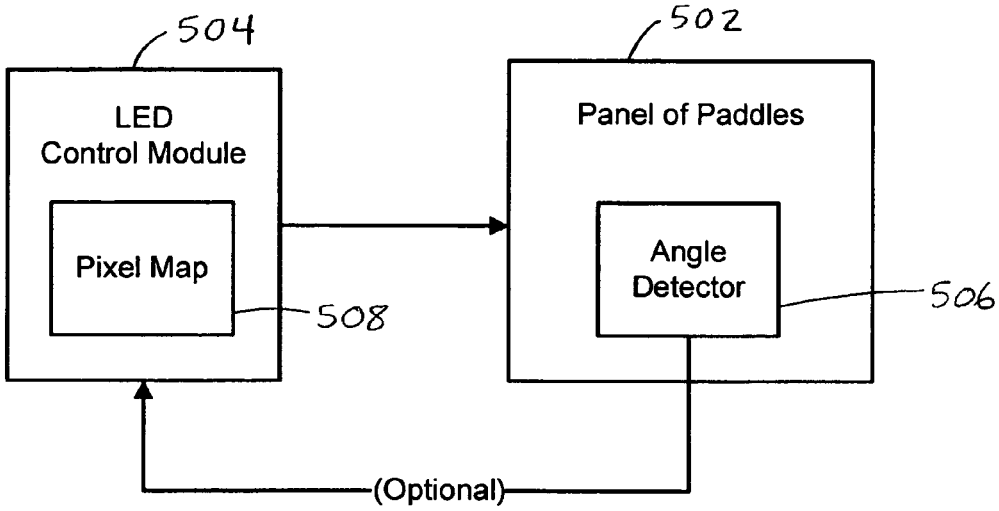
FIG. 5 is a block diagram illustrating an embodiment of a system for displaying an image.

FIG. 5 is a block diagram illustrating an embodiment of a system for displaying an image. In the example shown, panel of paddles 502 is a structure comprising one or more paddles. As more fully described below, panel of paddles 502 may include a plurality of paddles, which may include paddles of various sizes, lengths, and widths; paddles that rotate about a midpoint or an endpoint; paddles that rotate in the same sweep plane or in different sweep planes; paddles that rotate in phase or out of phase with each other; paddles that have multiple arms; and paddles that have other shapes. Panel of paddles 502 may include all identical paddles or a variety of different paddles. The paddles may be arranged in a grid or in any other arrangement. In some embodiments, the panel includes angle detector 506, which is used to detect angles associated with one or more of the paddles. In some embodiments, there is an angle detector for each paddle on panel of paddles 502. For example, an optical detector may be mounted near a paddle to detect its current angle.

LED control module 504 is configured to optionally receive current angle information (e.g., angle(s) or information associated with angle(s)) from angle detector 506. LED control module 504 uses the current angles to determine LED control data to send to panel of paddles 502. The LED control data indicates which LEDs should be activated at that time (sector). In some embodiments, LED control module 504 determines the LED control data using pixel map 508. In some embodiments, LED control module 504 takes an angle as input and outputs which LEDs on a paddle should be activated at that sector for a particular image. In some embodiments, an angle is sent from angle detector 506 to LED control module 504 for each sector (e.g., just prior to the paddle reaching the sector). In some embodiments, LED control data is sent from LED control module 504 to panel of paddles 502 for each sector.

In some embodiments, pixel map 508 is implemented using a lookup table, as more fully described below. For different images, different lookup tables are used. Pixel map 508 is more fully described below.

In some embodiments, there is no need to read an angle using angle detector 506. Because the angular velocity of the paddles and an initial angle of the paddles (at that angular velocity) can be predetermined, it can be computed at what angle a paddle is at any given point in time. In other words, the angle can be determined based on the time. For example, if the angular velocity is $\omega$, the angular location after time t is $\theta_{initial}+\omega t$ where $\theta_{initial}$ is an initial angle once the paddle is spinning at steady state. As such, LED control module can serially output LED control data as a function of time (e.g., using a clock), rather than use angle measurements output from angle detector 506. For example, a table of time (e.g., clock cycles) versus LED control data can be built.

In some embodiments, when a paddle is starting from rest, it goes through a start up sequence to ramp up to the steady state angular velocity. Once it reaches the angular velocity, an initial angle of the paddle is measured in order to compute at what angle the paddle is at any point in time (and determine at what point in the sequence of LED control data to start).

In some embodiments, angle detector 506 is used periodically to provide adjustments as needed. For example, if the angle has drifted, the output stream of LED control data can be shifted. In some embodiments, if the angular speed has drifted, mechanical adjustments are made to adjust the speed.

Figure 6A:
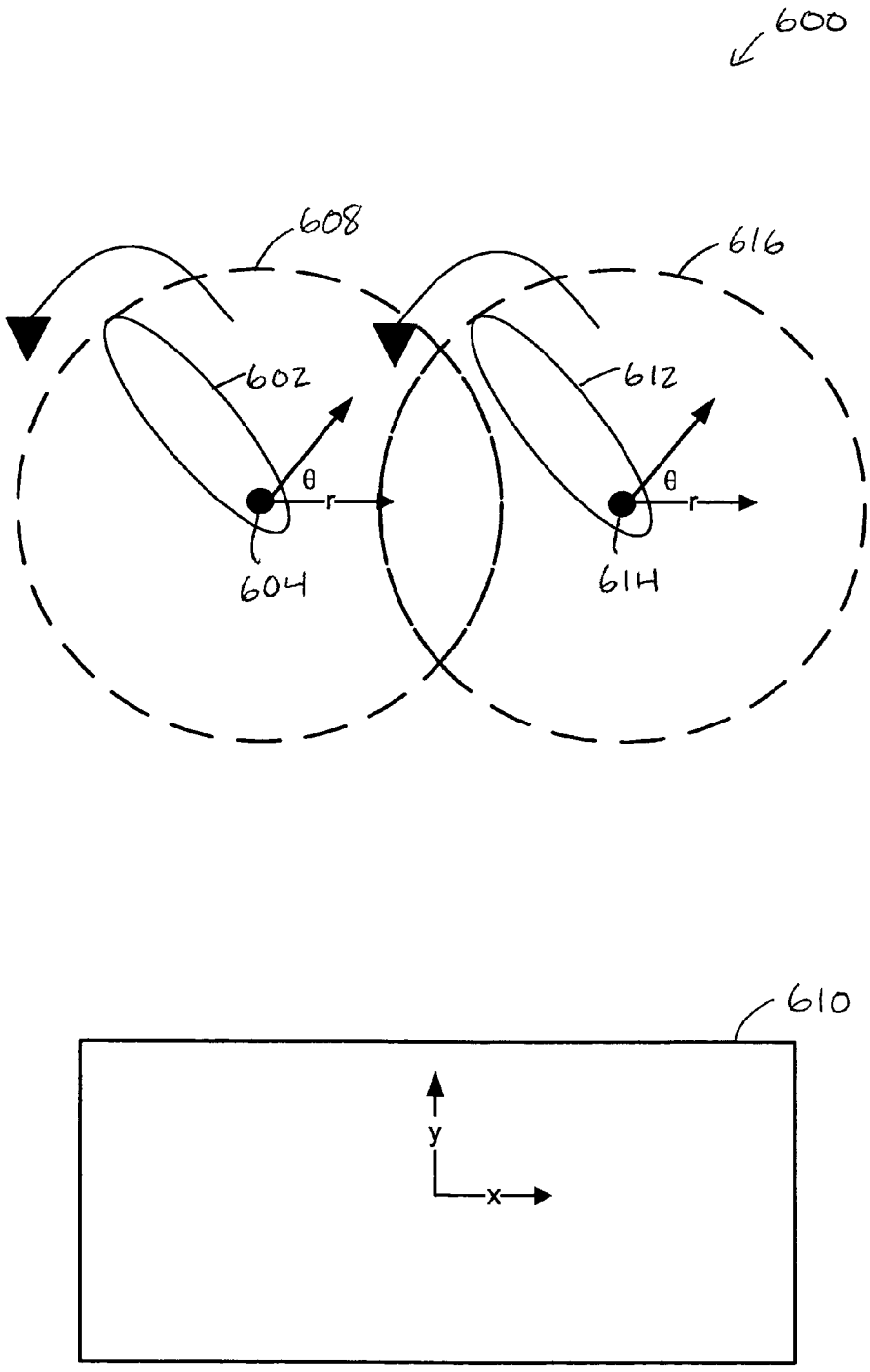
FIG. 6A is a diagram illustrating an embodiment of a composite display 600 having two paddles.

FIG. 6A is a diagram illustrating an embodiment of a composite display 600 having two paddles. In the example shown, a polar coordinate system is indicated over each of areas 608 and 616, with an origin located at each axis of rotation 604 and 614. In some implementations, the position of each LED on paddles 602 and 612 is recorded in polar coordinates. The distance from the origin to the LED is the radius r. The paddle angle is $\theta$. For example, if paddle 602 is in the 3 o'clock position, each of the LEDs on paddle 602 is at 0 degrees. If paddle 602 is in the 12 o'clock position, each of the LEDs on paddle 602 is at 90 degrees. In some embodiments, an angle detector is used to detect the current angle of each paddle. In some embodiments, a temporal pixel is defined by P, r, and $\theta$, where P is a paddle identifier and (r, $\theta$) are the polar coordinates of the LED.

A rectangular coordinate system is indicated over an image 610 to be displayed. In this example, the origin is located at the center of image 610, but it may be located anywhere depending on the implementation. In some embodiments, pixel map 508 is created by mapping each pixel in image 610 to one or more temporal pixels in display area 608 and 616. Mapping may be performed in various ways in various embodiments.

Figure 6B:
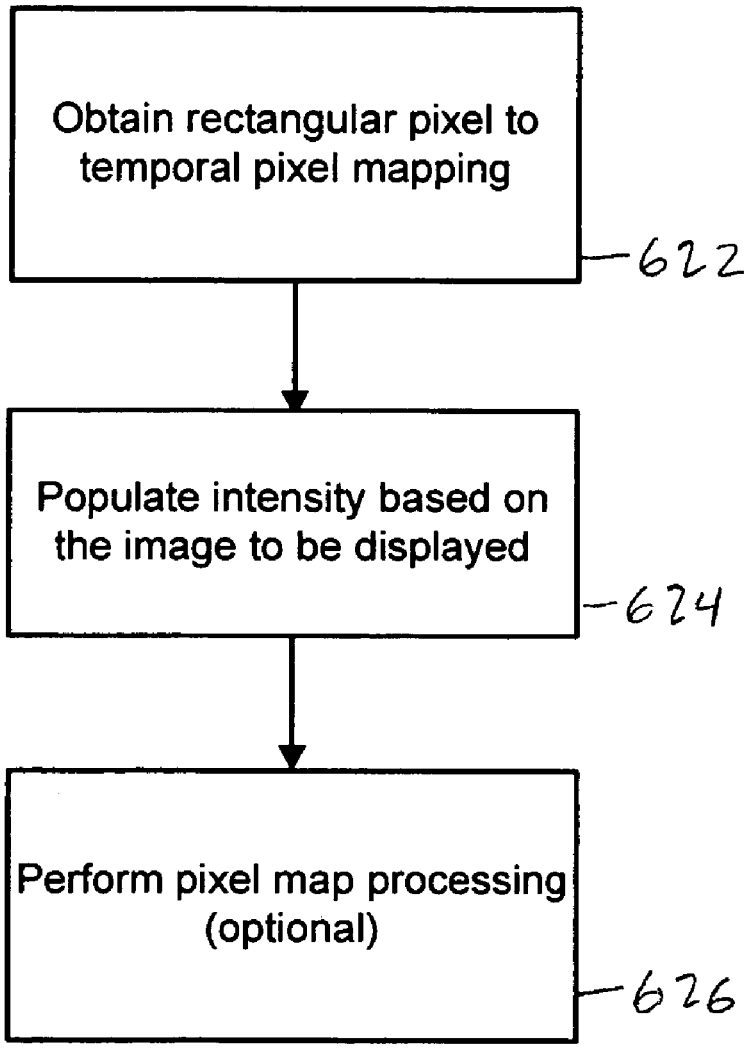
FIG. 6B is a flowchart illustrating an embodiment of a process for generating a pixel map.

FIG. 6B is a flowchart illustrating an embodiment of a process for generating a pixel map. For example, this process may be used to create pixel map 508. At 622, an image pixel to temporal pixel mapping is obtained. In some embodiments, mapping is performed by overlaying image 610 (with its rectangular grid of pixels (x, y) corresponding to the resolution of the image) over areas 608 and 616 (with their two polar grids of temporal pixels (r, $\theta$), e.g., see FIG. 2B). For each image pixel (x, y), it is determined which temporal pixels are within the image pixel. The following is an example of a pixel map:

TABLE 1

| Image pixel (x, y) | Temporal Pixel (P, r, $\theta$) | Intensity (f) |
|---|---|---|
| (a1, a2) | (b1, b2, b3) | |
| (a3, a4) | (b4, b5, b6); (b7, b8, b9) | |
| (a5, a6) | (b10, b11, b12) | |
| etc. | etc. | |

As previously stated, one image pixel may map to multiple temporal pixels as indicated by the second row. In some embodiments, instead of r, an index corresponding to the LED is used. In some embodiments, the image pixel to temporal pixel mapping is precomputed for a variety of image sizes and resolutions (e.g., that are commonly used).

At 624, an intensity f is populated for each image pixel based on the image to be displayed. In some embodiments, f indicates whether the LED should be on (e.g., 1) or off (e.g., 0). For example, in a black and white image (with no grayscale), black pixels map to f=1 and white pixels map to f=0. In some embodiments, f may have fractional values. In some embodiments, f is implemented using duty cycle management. For example, when f is 0, the LED is not activated for that sector time. When f is 1, the LED is activated for the whole sector time. When f is 0.5, the LED is activated for half the sector time. In some embodiments, f can be used to display grayscale images. For example, if there are 256 gray levels in the image, pixels with gray level 128 (half luminance) would have f=0.5. In some embodiments, rather than implement f using duty cycle (i.e., pulse width modulated), f is implemented by adjusting the current to the LED (i.e., pulse height modulation).

For example, after the intensity f is populated, the table may appear as follows:

TABLE 2

| Image pixel (x, y) | Temporal Pixel (P, r, $\theta$) | Intensity (f) |
|---|---|---|
| (a1, a2) | (b1, b2, b3) | f1 |
| (a3, a4) | (b4, b5, b6); (b7, b8, b9) | f2 |
| (a5, a6) | (b10, b11, b12) | f3 |
| etc. | etc. | etc. |

At 626, optional pixel map processing is performed. This may include compensating for overlap areas, balancing luminance in the center (i.e., where there is a higher density of temporal pixels), balancing usage of LEDs, etc. For example, when LEDs are in an overlap area (and/or on a boundary of an overlap area), their duty cycle may be reduced. For example, in composite display 300, when LEDs are in overlap area 318, their duty cycle is halved. In some embodiments, there are multiple LEDs in a sector time that correspond to a single image pixel, in which case, fewer than all the LEDs may be activated (i.e., some of the duty cycles may be set to 0). In some embodiments, the LEDs may take turns being activated (e.g., every N cycles where N is an integer), e.g., to balance usage so that one doesn't burn out earlier than the others. In some embodiments, the closer the LEDs are to the center (where there is a higher density of temporal pixels), the lower their duty cycle.

For example, after luminance balancing, the pixel map may appear as follows:

TABLE 3

| Image pixel (x, y) | Temporal Pixel (P, r, θ) | Intensity (f) |
|---|---|---|
| (a1, a2) | (b1, b2, b3) | f1 |
| (a3, a4) | (b4, b5, b6) | f2 |
| (a5, a6) | (b10, b11, b12) | f3 |
| etc. | etc. | etc. |

As shown, in the second row, the second temporal pixel was deleted in order to balance luminance across the pixels. This also could have been accomplished by halving the intensity to f2/2. As another alternative, temporal pixel (b4, b5, b6) and (b7, b8, b9) could alternately turn on between cycles. In some embodiments, this can be indicated in the pixel map. The pixel map can be implemented in a variety of ways using a variety of data structures in different implementations.

For example, in FIG. 5, LED control module 504 uses the temporal pixel information (P, r, θ, and f) from the pixel map. LED control module 504 takes θ as input and outputs LED control data P, r, and f. Panel of paddles 502 uses the LED control data to activate the LEDs for that sector time. In some embodiments, there is an LED driver for each paddle that uses the LED control data to determine which LEDs to turn on, if any, for each sector time.

Any image (including video) data may be input to LED control module 504. In various embodiments, one or more of 622, 624, and 626 may be computed live or in real time, i.e., just prior to displaying the image. This may be useful for live broadcast of images, such as a live video of a stadium. For example, in some embodiments, 622 is precomputed and 624 is computed live or in real time. In some implementations, 626 may be performed prior to 622 by appropriately modifying the pixel map. In some embodiments, 622, 624, and 626 are all precomputed. For example, advertising images may be precomputed since they are usually known in advance.

The process of FIG. 6B may be performed in a variety of ways in a variety of embodiments. Another example of how 622 may be performed is as follows. For each image pixel (x, y), a polar coordinate is computed. For example, (the center of) the image pixel is converted to polar coordinates for the sweep areas it overlaps with (there may be multiple sets of polar coordinates if the image pixel overlaps with an overlapping sweep area). The computed polar coordinate is rounded to the nearest temporal pixel. For example, the temporal pixel whose center is closest to the computed polar coordinate is selected. (If there are multiple sets of polar coordinates, the temporal pixel whose center is closest to the computed polar coordinate is selected.) This way, each image pixel maps to at most one temporal pixel. This may be desirable because it maintains a uniform density of activated temporal pixels in the display area (i.e., the density of activated temporal pixels near an axis of rotation is not higher than at the edges). For example, instead of the pixel map shown in Table 1, the following pixel map may be obtained:

TABLE 4

| Image pixel (x, y) | Temporal Pixel (P, r, θ) | Intensity (f) |
|---|---|---|
| (a1, a2) | (b1, b2, b3) | |
| (a3, a4) | (b7, b8, b9) | |
| (a5, a6) | (b10, b11, b12) | |
| etc. | etc. | |

In some cases, using this rounding technique, two image pixels may map to the same temporal pixel. In this case, a variety of techniques may be used at 626, including, for example: averaging the intensity of the two rectangular pixels and assigning the average to the one temporal pixel; alternating between the first and second rectangular pixel intensities between cycles; remapping one of the image pixel to a nearest neighbor temporal pixel; etc.

Figure 7:
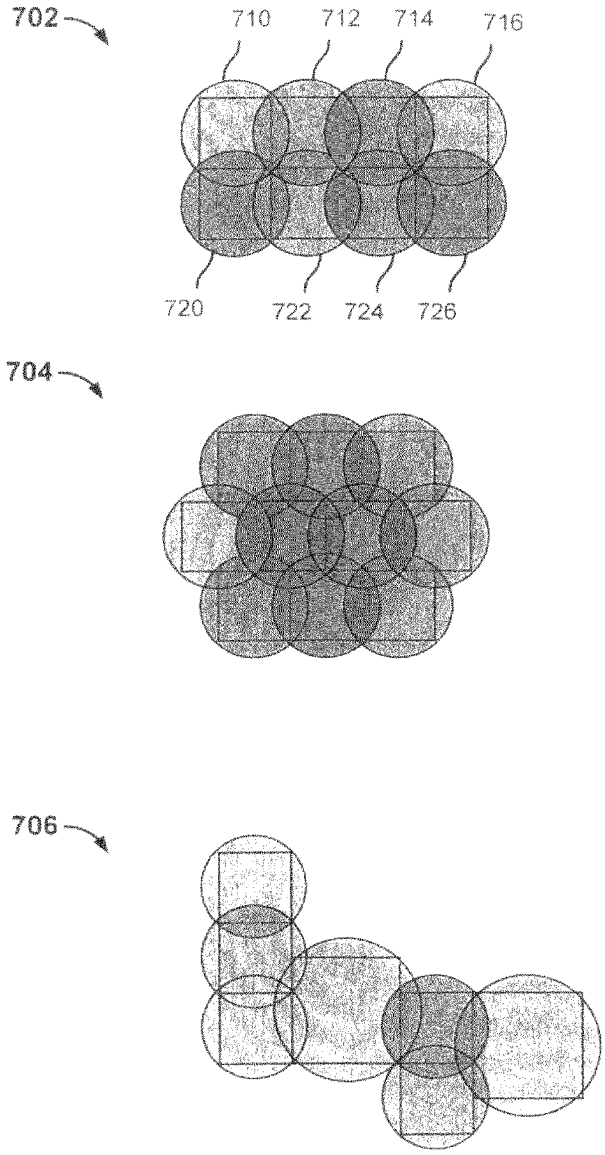
FIG. 7 illustrates examples of paddles arranged in various arrays.

FIG. 7 illustrates examples of paddles arranged in various arrays. For example, any of these arrays may comprise panel of paddles 502. Any number of paddles may be combined in an array to create a display area of any size and shape.

Arrangement 702 shows eight circular sweep areas corresponding to eight paddles each with the same size. The sweep areas overlap as shown. In addition, rectangular display areas are shown over each sweep area. For example, the maximum rectangular display area for this arrangement would comprise the union of all the rectangular display areas shown. To avoid having a gap in the maximum display area, the maximum spacing between axes of rotation is $\sqrt{2}$ R, where R is the radius of one of the circular sweep areas. The spacing between axes is such that the periphery of one sweep area does not overlap with any axes of rotation, otherwise there would be interference. Any combination of the sweep areas and rectangular display areas may be used to display one or more images.

In some embodiments, the eight paddles are in the same sweep plane. In some embodiments, the eight paddles are in different sweep planes. It may be desirable to minimize the number of sweep planes used. For example, it is possible to have every other paddle sweep the same sweep plane. For example, sweep areas 710, 714, 722, and 726 can be in the same sweep plane, and sweep areas 712, 716, 720, and 724 can be in another sweep plane.

In some configurations, sweep areas (e.g., sweep areas 710 and 722) overlap each other. In some configurations, sweep areas are tangent to each other (e.g., sweep areas 710 and 722 can be moved apart so that they touch at only one point). In some configurations, sweep areas do not overlap each other (e.g., sweep areas 710 and 722 have a small gap between them), which is acceptable if the desired resolution of the display is sufficiently low.

Arrangement 704 shows ten circular sweep areas corresponding to ten paddles. The sweep areas overlap as shown. In addition, rectangular display areas are shown over each sweep area. For example, three rectangular display areas, one in each row of sweep areas, may be used, for example, to display three separate advertising images. Any combination of the sweep areas and rectangular display areas may be used to display one or more images.

Arrangement 706 shows seven circular sweep areas corresponding to seven paddles. The sweep areas overlap as shown. In addition, rectangular display areas are shown over each sweep area. In this example, the paddles have various sizes so that the sweep areas have different sizes. Any combination of the sweep areas and rectangular display areas may be used to display one or more images. For example, all the sweep areas may be used as one display area for a non-rectangular shaped image, such as a cut out of a giant serpent.

Figure 8:
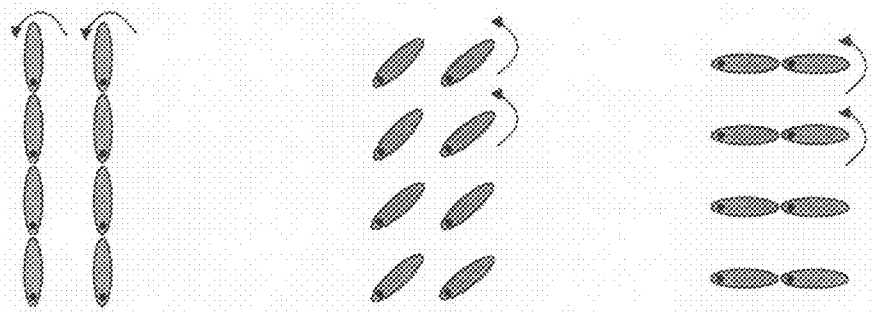
FIG. 8 illustrates examples of paddles with coordinated in phase motion to prevent mechanical interference.

FIG. 8 illustrates examples of paddles with coordinated in phase motion to prevent mechanical interference. In this example, an array of eight paddles is shown at three points in time. The eight paddles are configured to move in phase with each other; that is, at each point in time, each paddle is oriented in the same direction (or is associated with the same angle when using the polar coordinate system described in FIG. 6A).

Figure 9:
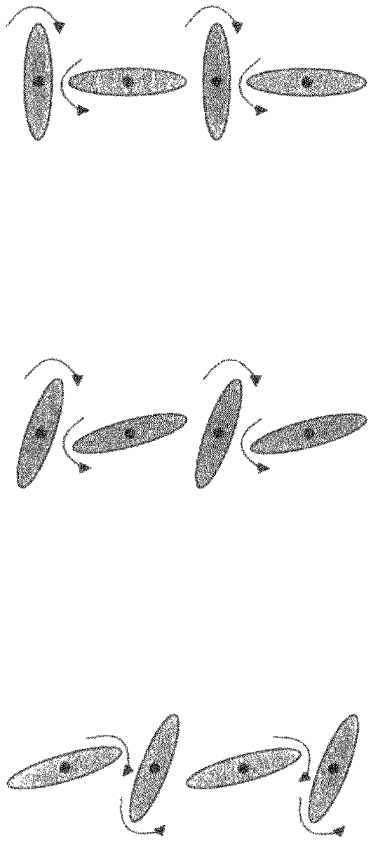
FIG. 9 illustrating examples of paddles with coordinated out of phase motion to prevent mechanical interference.

FIG. 9 illustrating examples of paddles with coordinated out of phase motion to prevent mechanical interference. In this example, an array of four paddles is shown at three points in time. The four paddles are configured to move out of phase with each other; that is, at each point in time, at least one paddle is not oriented in the same direction (or is associated with the same angle when using the polar coordinate system described in FIG. 6A) as the other paddles. In this case, even though the paddles move out of phase with each other, their phase difference (difference in angles) is such that they do not mechanically interfere with each other.

The display systems described herein have a naturally built in cooling system. Because the paddles are spinning, heat is naturally drawn off of the paddles. The farther the LED is from the axis of rotation, the more cooling it receives. In some embodiments, this type of cooling is at least 10× effective as systems in which LED tiles are stationary and in which an external cooling system is used to blow air over the LED tiles using a fan. In addition, a significant cost savings is realized by not using an external cooling system.

Although in the examples herein, the image to be displayed is provided in pixels associated with rectangular coordinates and the display area is associated with temporal pixels described in polar coordinates, the techniques herein can be used with any coordinate system for either the image or the display area.

Although rotational movement of paddles is described herein, any other type of movement of paddles may also be used. For example, a paddle may be configured to move from side to side (producing a rectangular sweep area, assuming the LEDs are aligned in a straight row). A paddle may be configured to rotate and simultaneously move side to side (producing an elliptical sweep area). A paddle may have arms that are configured to extend and retract at certain angles, e.g., to produce a more rectangular sweep area. Because the movement is known, a pixel map can be determined, and the techniques described herein can be applied.

Figure 10:
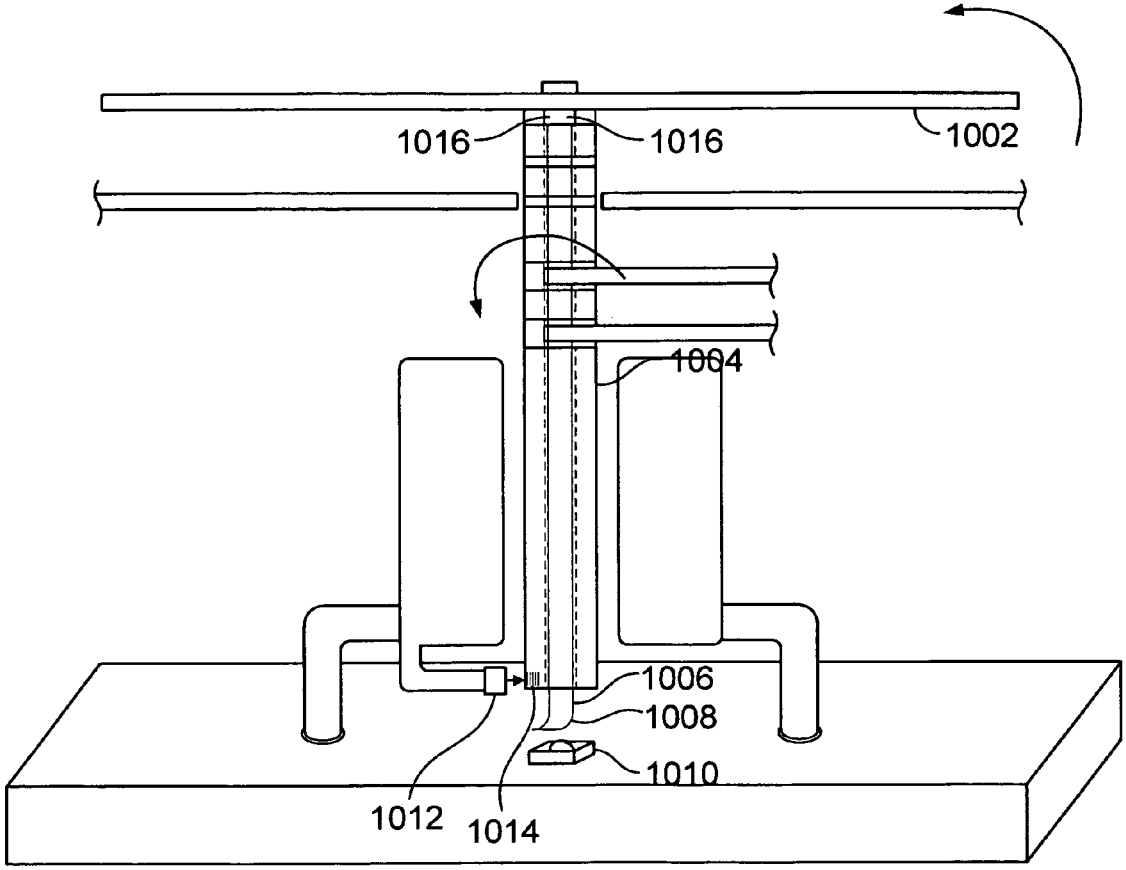
FIG. 10 is a diagram illustrating an example of a cross section of a paddle in a composite display.

FIG. 10 is a diagram illustrating an example of a cross section of a paddle in a composite display. This example is shown to include paddle 1002, shaft 1004, optical fiber 1006, optical camera 1012, and optical data transmitter 1010. Paddle 1002 is attached to shaft 1004. Shaft 1004 is bored out (i.e., hollow) and optical fiber 1006 runs through its center. The base 1008 of optical fiber 1006 receives data via optical data transmitter 1010. The data is transmitted up optical fiber 1006 and transmitted at 1016 to an optical detector (not shown) on paddle 1002. The optical detector provides the data to one or more LED drivers used to activate one or more LEDs on paddle 1002. In some embodiments, LED control data that is received from LED control module 504 is transmitted to the LED driver in this way.

In some embodiments, the base of shaft 1004 has appropriate markings 1014 that are read by optical camera 1012 to determine the current angular position of paddle 1002. In some embodiments, optical camera 1012 is used in conjunction with angle detector 506 to output angle information that is fed to LED control module 508 as shown in FIG. 5.

In some embodiments, it is desirable for an image or a portion of an image rendered by the pixel elements of a paddle of a composite display to have a uniform or nearly uniform luminance. Various techniques may be employed to ensure that an image or a portion of an image rendered by the pixel elements of a paddle of a composite display has a uniform or nearly uniform luminance.

Figure 11:
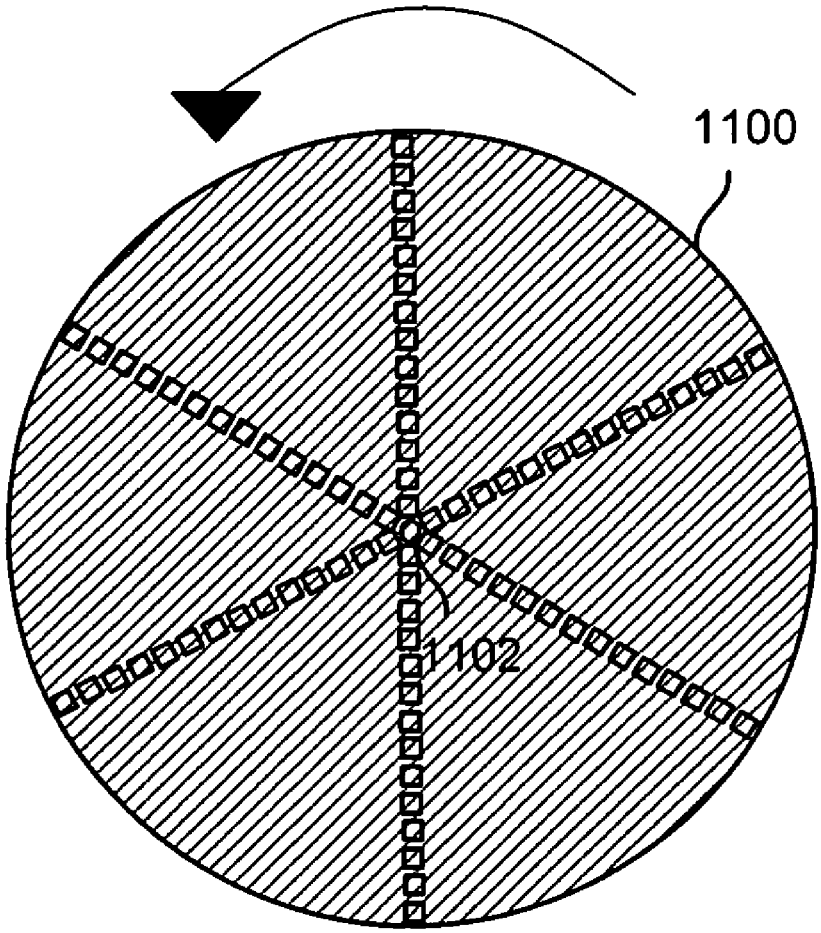
FIG. 11 illustrates an embodiment of a paddle.

As previously described, in some embodiments, temporal pixels may become denser near an axis of rotation of a paddle. A larger density of temporal pixels near an axis of rotation may result, for example, if the pixel elements of a paddle are uniformly spaced along a length and/or radius of the paddle. The pixel element configurations of paddle 202 of FIG. 2A, paddle 222 of FIG. 2B, and paddles 426 and 428 of FIG. 4B, for example, result in higher densities of temporal pixels near the respective axes of rotations. FIG. 11 illustrates another example of a paddle whose pixel element configuration results in a higher density of temporal pixels near its axis of rotation. Specifically, FIG. 11 illustrates an embodiment of a circularly shaped paddle 1100 that rotates about axis of rotation 1102. Paddle 1100 comprises a disc onto which pixel elements are attached or mounted. In the given example, pixel elements are uniformly spaced along the radii of paddle 1100.

In some embodiments, pixel elements with lower maximum intensity values are installed near the axis of rotation of a paddle, and pixel elements with higher maximum intensity values are installed farther away from the axis of rotation of the paddle to aid in balancing luminance. Thus, even though the density of temporal pixels is higher near axis of rotation 1102 of paddle 1100, a more uniform luminance can be obtained by employing lower intensity pixel elements closer to the center of paddle 1100 and higher intensity pixel elements closer to the edge or circumference of paddle 1100. For example, in the cases in which the pixel elements of a paddle comprise color pixel elements so that a grayscale color image can be rendered, low intensity, tri-color RGB LEDs may be installed near the axis of rotation and high intensity red, green, and/or blue LEDs may be installed farther away from the axis of rotation.

In some embodiments, modulation of the pulse width (i.e. duty cycle) and/or pulse height (i.e. amplitude) of the voltage applied to and/or current delivered to a pixel element may be employed to balance luminance. For example, pixel elements close to an axis of rotation of a paddle may be activated with a lower duty cycle and/or with a lower amplitude relative to pixel elements located farther away from the axis of rotation so that the luminance of the display is more uniform.

Figure 12:
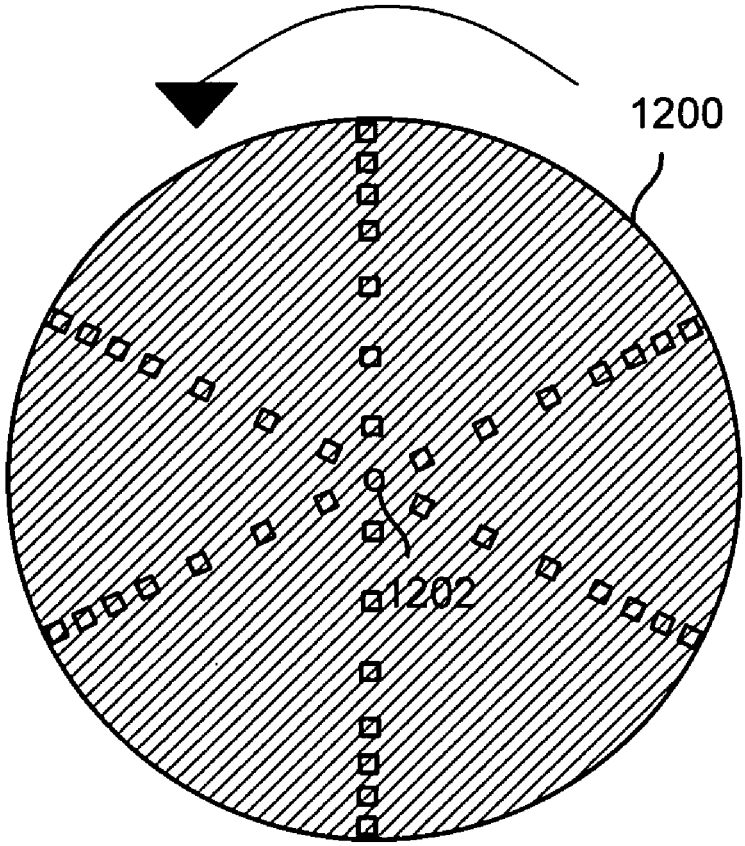
FIG. 12 illustrates an embodiment of a paddle.
Figure 13:
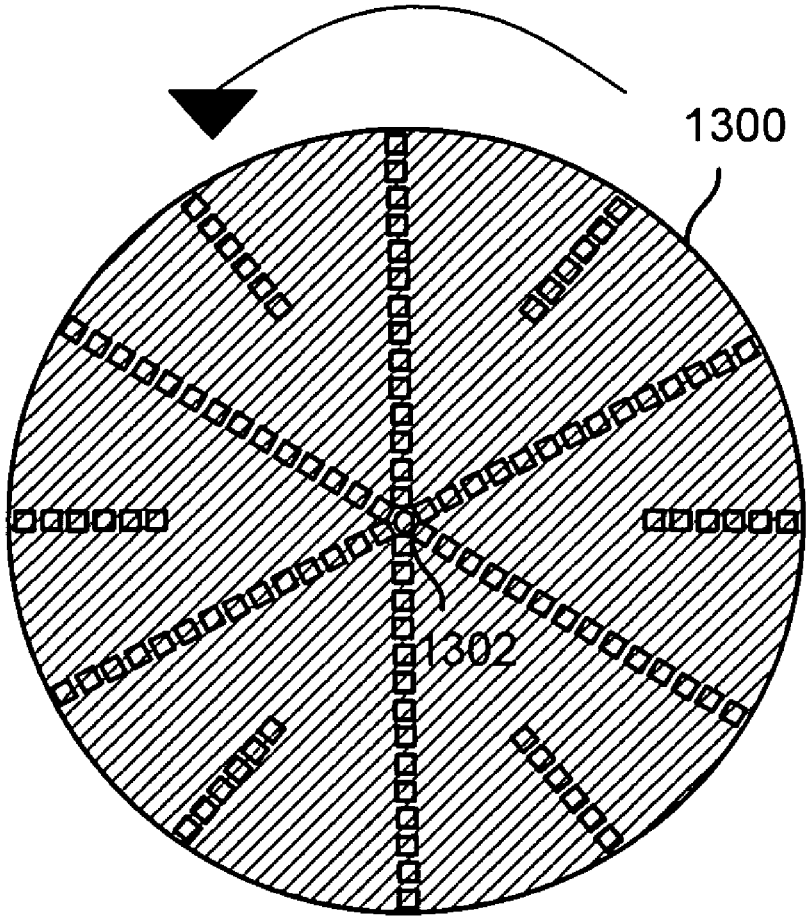
FIG. 13 illustrates an embodiment of a paddle.
Figure 14:
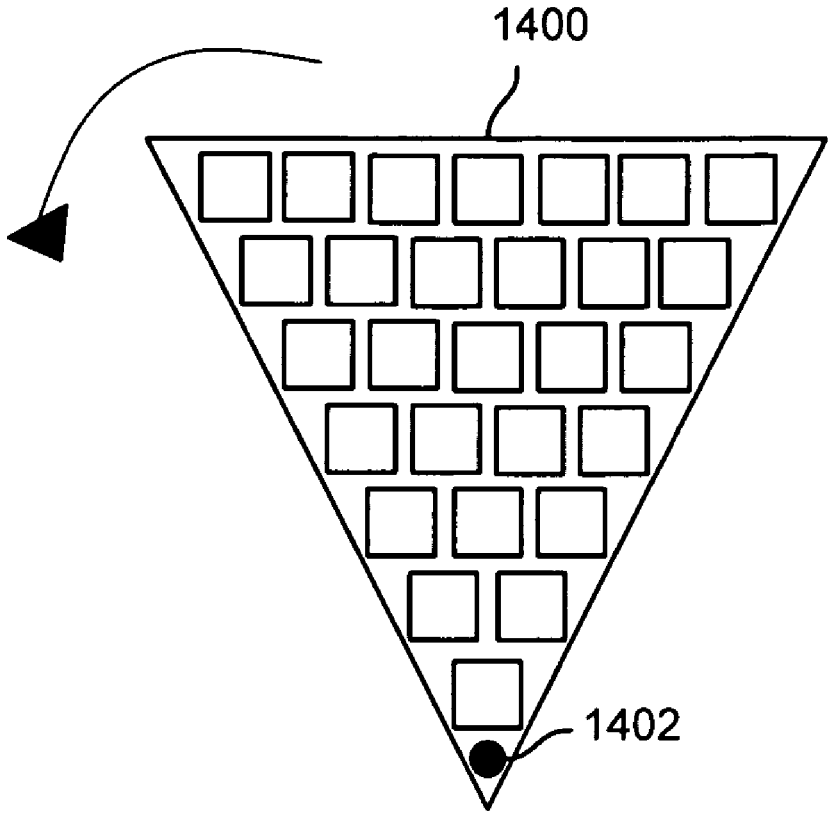
FIG. 14 illustrates an embodiment of a paddle.

In some embodiments, it is desirable for the density of the temporal pixels of a paddle of a composite display to be more uniform so that the luminance of an image or a portion of an image rendered by the paddle is more uniform. In some embodiments, a lower density of pixel elements is installed near the axis of rotation of a paddle. FIG. 12 illustrates an embodiment of a circularly shaped paddle 1200 that rotates about axis of rotation 1202. Paddle 1200 comprises a disc onto which pixel elements are attached or mounted. In the given example, a non-uniform spacing is employed along each radii of pixel elements of paddle 1200 such that the pitch between pixel elements is coarser near axis of rotation 1202 and finer farther away from axis of rotation 1202. That is, pixel elements are placed closer together on the paddle the farther they are from axis of rotation 1202. FIG. 13 illustrates an embodiment of a circularly shaped paddle 1300 that rotates about axis of rotation 1302. Paddle 1300 comprises a disc onto which pixel elements are attached or mounted. In the given example, the pitch between pixel elements along each radii is uniform, but a higher density of pixel elements is installed near the edge of paddle 1300. FIG. 14 illustrates an embodiment of a paddle 1400 that rotates about axis of rotation 1402. Paddle 1400 is triangularly shaped and includes a plurality of pixel elements. The triangular shape of paddle 1400 results in room for fewer pixel elements near axis of rotation 1402 and more pixel elements farther away from axis of rotation 1402. In other embodiments, paddle 1400 may be any shape that provides space to mount more pixel elements farther away from axis of rotation 1402.

In various embodiments, any combination of one or more techniques may be employed to obtain a substantially uniform luminance for the portion of a composite display rendered by the pixel elements of a paddle. As described, such luminance balancing techniques may be based on a characteristic associated with radial distance from an axis of rotation of the paddle and may include, for example, employing one or more (successively) higher intensity pixel elements at increasing radial distances from the axis of rotation, activating pixel elements at one or more (successively) higher duty cycle and/or amplitude values at increasing radial distances from the axis of rotation, installing one or more (successively) higher densities of pixel elements at increasing radial distances from the axis of rotation, etc.

In some embodiments, during image pixel to temporal pixel mapping, each image pixel is assigned to a single, unique temporal pixel so that the resolution of the source image can be preserved in the composite display and so that the luminance of the composite display is balanced. In some embodiments, as previously described with respect to FIG. 6B, each image pixel (x, y) in rectilinear coordinates is converted into polar coordinates, and the computed polar coordinates of the image pixel are rounded, if necessary, to the nearest valid temporal pixel. In such cases, during image pixel to temporal pixel mapping, zero or more image pixels may be mapped into a single temporal pixel. A mapping of more than one image pixel to a temporal pixel may result from a rounding error during the rectilinear to polar coordinate conversion. In the cases in which more than one image pixel is mapped to a temporal pixel, in some embodiments, all but one of the image pixels are remapped to neighboring or nearby temporal pixels so that each temporal pixel is associated with at most a single image pixel. Thus, in such cases, each image pixel is mapped to a unique temporal pixel, preserving the resolution of the source image in the composite display and resulting in a balanced luminance across the composite display.

In the cases in which the resolution of the temporal pixel grid is greater than the resolution of the source image, no (i.e. zero) image pixels may be mapped to a temporal pixel. Such temporal pixels are inactive. It may be desirable to not have too many inactive temporal pixels in a composite display, especially away from an axis of rotation where each temporal pixel corresponds to a larger area of the display, since such inactive or degenerate temporal pixels may result in perceptible dark spot artifacts in the rendered image. In some embodiments, at least a portion of the intensity value assigned to a temporal pixel to which an image pixel mapped is distributed to one or more neighboring and/or nearby inactive temporal pixels which results in the one or more inactive temporal pixels to become active, removing the dark spot artifacts from a rendered image that would have resulted had the one or more inactive temporal pixels remained inactive. In some embodiments, (e.g., the configuration shown in FIG. 11), the area associated with a temporal pixel depends on the radial distance of the temporal pixel from an axis of rotation of an associated paddle, with the area increasing with increasing radial distance. In some embodiments, the intensity value of a temporal pixel is distributed to neighboring and/or nearby inactive temporal pixels in a circumferential direction so that the area weight of all temporal pixels across which an intensity value is distributed is uniform.

For example, if an inactive temporal pixel exists in the circumferential direction (i.e., at the same radial distance from an axis of rotation but at a different angle) between two temporal pixels each of which is mapped to a corresponding image pixel, one-third of the intensity value of each of the two temporal pixels above and below the inactive temporal pixel is assigned to the inactive temporal pixel in the middle so that each of the three temporal pixels is active and rendered with a two-thirds intensity value. In some embodiments, the intensity values of temporal pixels to which image pixels are mapped are distributed and/or spread to one or more inactive temporal pixels along the same circumference to the extent possible and/or necessary to remove any undesirable artifacts which would result if the one or more inactive temporal pixels remained inactive. In some such cases, the same or close to the same fraction of an intensity value may be selected for as many temporal pixels as possible in a display to achieve a substantially uniform luminance across the display. In some cases, the presence of inactive temporal pixels near an axis of rotation may be acceptable since each temporal pixel near an axis of rotation is associated with a very small area of the composite display and as a result may be imperceptible to the eye. However, inactive temporal pixels near the outer edge of a display may correspond to a much larger area of the display, and in such cases distributing intensity values from one or more neighboring and/or nearby temporal pixels along the same circumference may be needed to mitigate or remove otherwise perceptible dark spot artifacts resulting from inactive temporal pixels.

Figure 15:
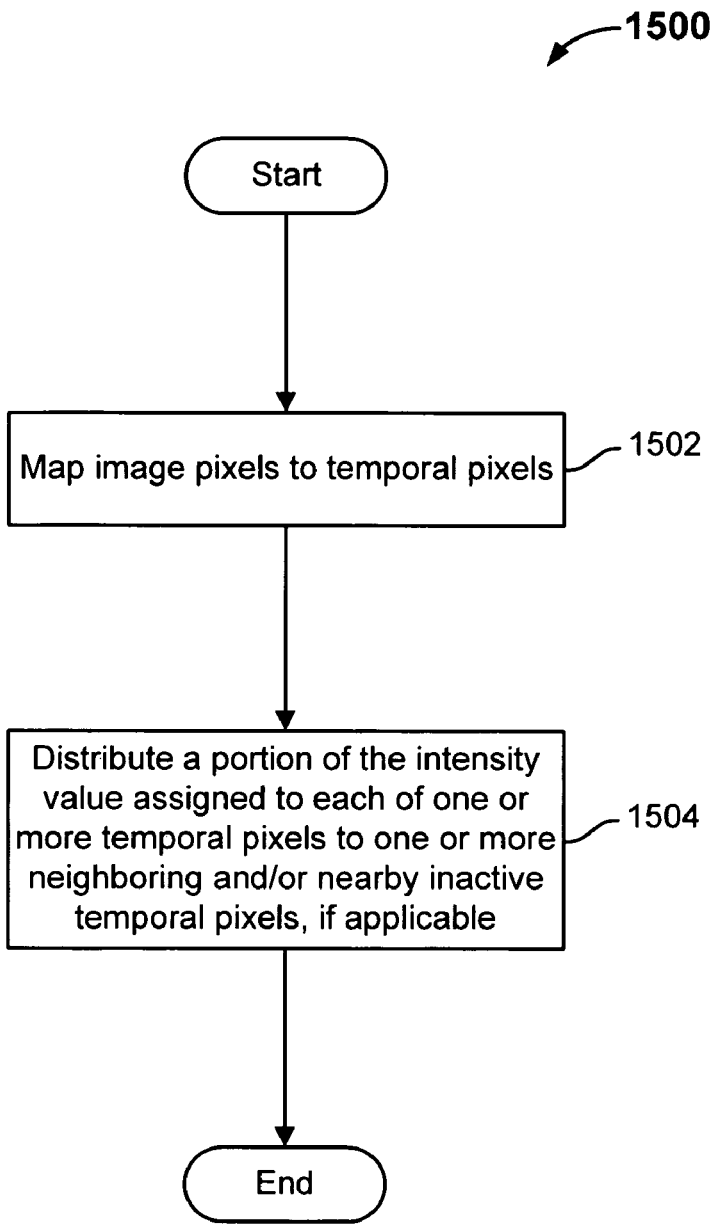
FIG. 15 illustrates an embodiment of a process for distributing intensity values.

FIG. 15 illustrates an embodiment of a process for distributing intensity values. Process 1500 starts at 1502 at which image pixels of a source image are mapped to temporal pixels of a composite display. As described, the rectilinear (x, y) coordinates of each image pixel may be converted into polar coordinates and rounded to the nearest valid temporal pixel. In some embodiments, 1502 includes remapping an image pixel to a different neighboring and/or nearby temporal pixel if the temporal pixel to which it is initially mapped is associated with a different image pixel. In some embodiments, each image pixel is mapped to a unique temporal pixel to which no other image pixels are mapped. At 1504, a portion of the intensity value assigned to each of one or more temporal pixels during the mapping at 1502 is distributed to one or more neighboring and/or nearby inactive temporal pixels, if applicable, and process 1500 ends. In some embodiments, the one or more neighboring and/or nearby inactive temporal pixels to which an intensity value of a temporal pixel is distributed are along the same circumference as the temporal pixel. In some embodiments, portions of the intensity values of multiple temporal pixels may be distributed to an inactive temporal pixel.

Spreading out or distributing the intensity assigned to a temporal pixel to neighboring and/or nearby inactive temporal pixels is in some embodiments possible using a driver chip (e.g., for doing pulse width and/or height modulation on pixel elements to render different intensities) that has sufficient bit depth to allow the intensity or grayscale value to be spread out across multiple temporal pixels. For example, in some cases, a 12-bit driver provides sufficient bit depth. In some such cases, 8 bits are employed for true color, and 4 bits are employed for distribution.

In various embodiments, any appropriate paddle configuration may be employed in a composite display. In some embodiments, a paddle of a composite display comprises a compound paddle that includes a plurality of components. In various embodiments, a compound paddle may be comprised of any desired number, shapes, and/or sizes of components. One or more components of a compound paddle may be associated with an independent axis of movement. One or more components of a compound paddle may impart motion to one or more other components of the compound paddle. The components of a compound paddle may be linked or connected in any appropriate manner. Pixel elements may be mounted in any appropriate manner on one or more of the components of a compound paddle. In some embodiments, pixel elements are installed on at least one component of a compound paddle.

Figure 16:
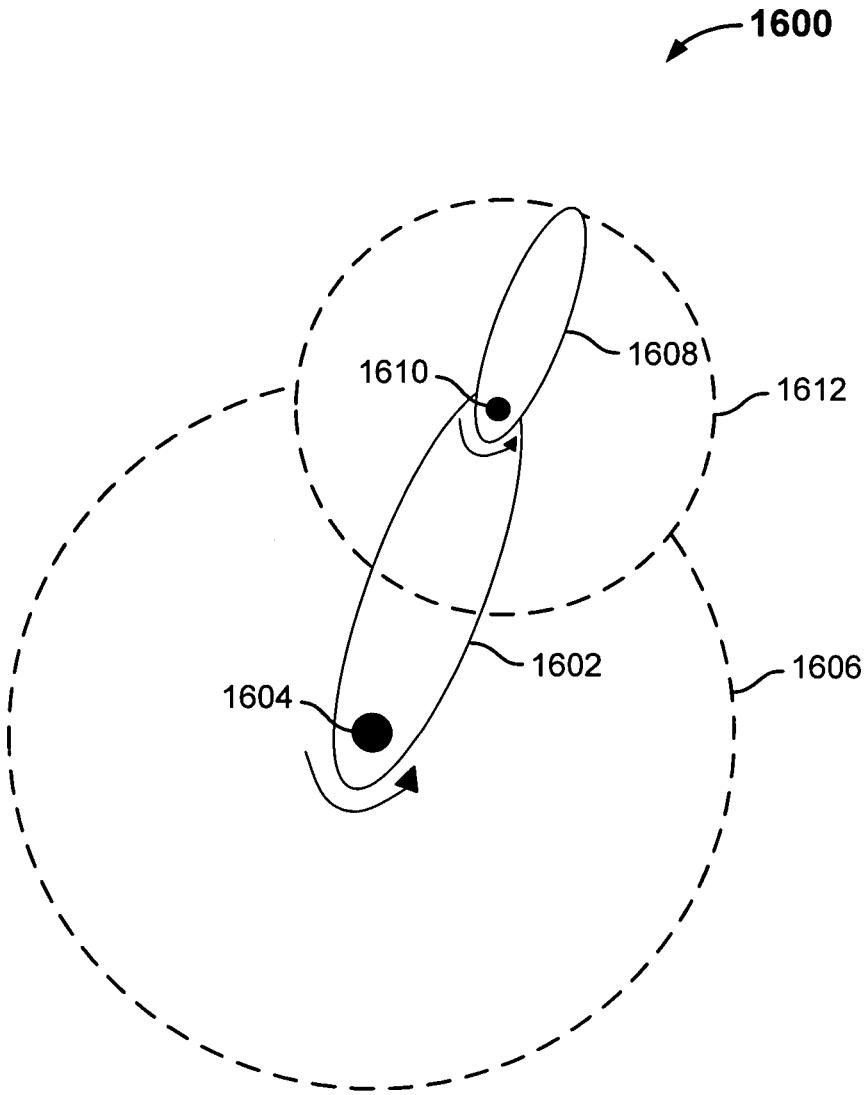
FIG. 16 illustrates an embodiment of a compound paddle.
Figure 17:
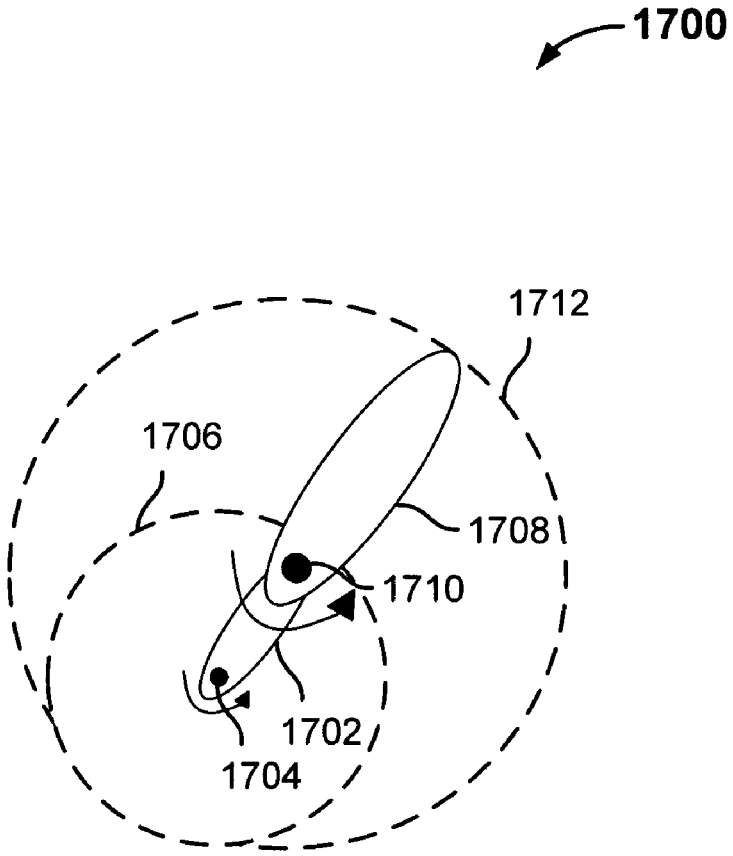
FIG. 17 illustrates an embodiment of a compound paddle.

FIG. 16 illustrates an embodiment of a compound paddle 1600 that includes two components: component 1602 which rotates about axis of rotation 1604 and sweeps out area 1606 and component 1608 which rotates about axis of rotation 1610 and sweeps out area 1612. As depicted, axis of rotation 1610 of smaller component 1608 of compound paddle 1600 is attached or coupled to the end of larger component 1602. Components 1602 and 1608 may rotate at the same and/or different rates of rotation. Pixel elements may be mounted in any appropriate configuration on one or more of components 1602 and 1608. FIG. 17 illustrates an embodiment of a compound paddle 1700 that includes two components: component 1702 which rotates about axis of rotation 1704 and sweeps out area 1706 and component 1708 which rotates about axis of rotation 1710 and sweeps out area 1712. As depicted, axis of rotation 1710 of larger component 1708 of compound paddle 1700 is attached or coupled to the end of smaller component 1702. Components 1702 and 1708 may rotate at the same and/or different rates of rotation. Pixel elements may be mounted in any appropriate configuration on one or more of components 1702 and 1708. Although in the examples of FIGS. 16 and 17, two components of different sizes are coupled to form a compound paddle, in other embodiments, any number of components of various shapes and sizes may be similarly linked to form a compound paddle.

Figure 18A:
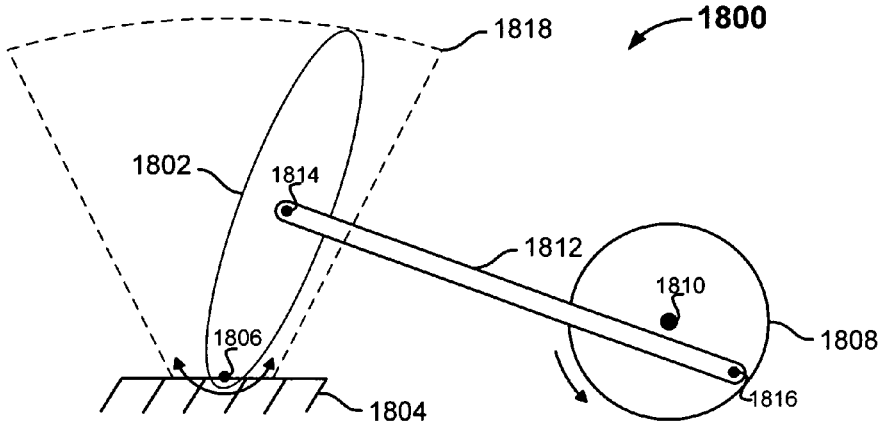
FIG. 18A illustrates an embodiment of a compound paddle.
Figure 18B:
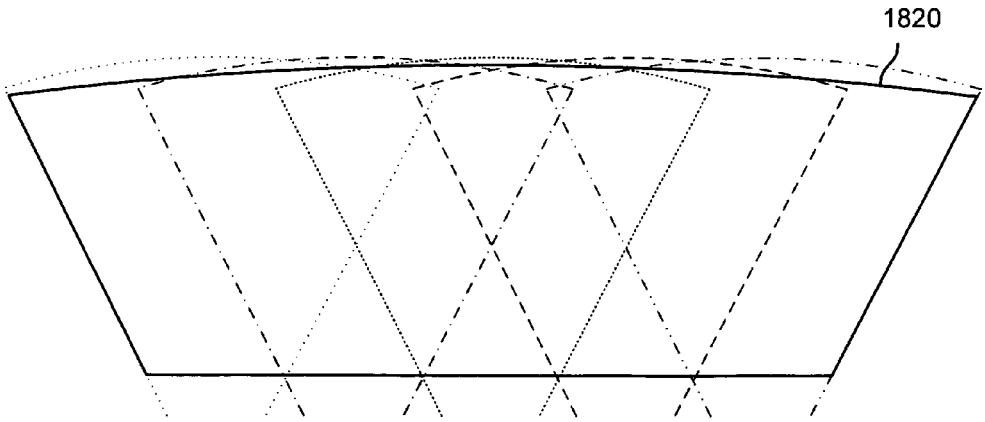
FIG. 18B illustrates an embodiment of a display area.

FIG. 18A illustrates an embodiment of a compound paddle 1800 that includes three components: component 1802 fixed to location 1804 and configured to rotate at least partially about axis of rotation 1806, component 1808 fixed at axis of rotation 1810 and configured to rotate at least partially about axis of rotation 1810, and component 1812 which is coupled to component 1802 and component 1808 at anchor points 1814 and 1816, respectively. In some embodiments, pixel elements are mounted only on component 1802. Component 1808 provides rotary motion which is at least in part converted into translational motion for component 1802 by linkage of component 1802 to component 1808 via component 1812. Thus, in the example of FIG. 18A, components 1808 and 1812 impart at least part of the motion of component 1802, which also rotates at least partially about axis of rotation 1806. Component 1802 sweeps out a sector-like area 1818. In some embodiments, the use of components 1808 and 1812 to deliver motion to component 1802 eliminates the need for a motor to move component 1802 in a desired manner. In various embodiments, one or more of components 1802, 1808, and 1812 of compound paddle 1800 may be situated in the same and/or different planes. In some embodiments, a plurality of components similar to component 1802 may be installed in series such that each produces a sweep area similar to sweep area 1818 of component 1802. If the sweep areas of such components (each of which is depicted in FIG. 18B with a different dotted line pattern) overlap as depicted in FIG. 18B, a composite display that has a display area 1820 in the shape of a windshield may be generated as depicted in FIG. 18B.

Figure 19:
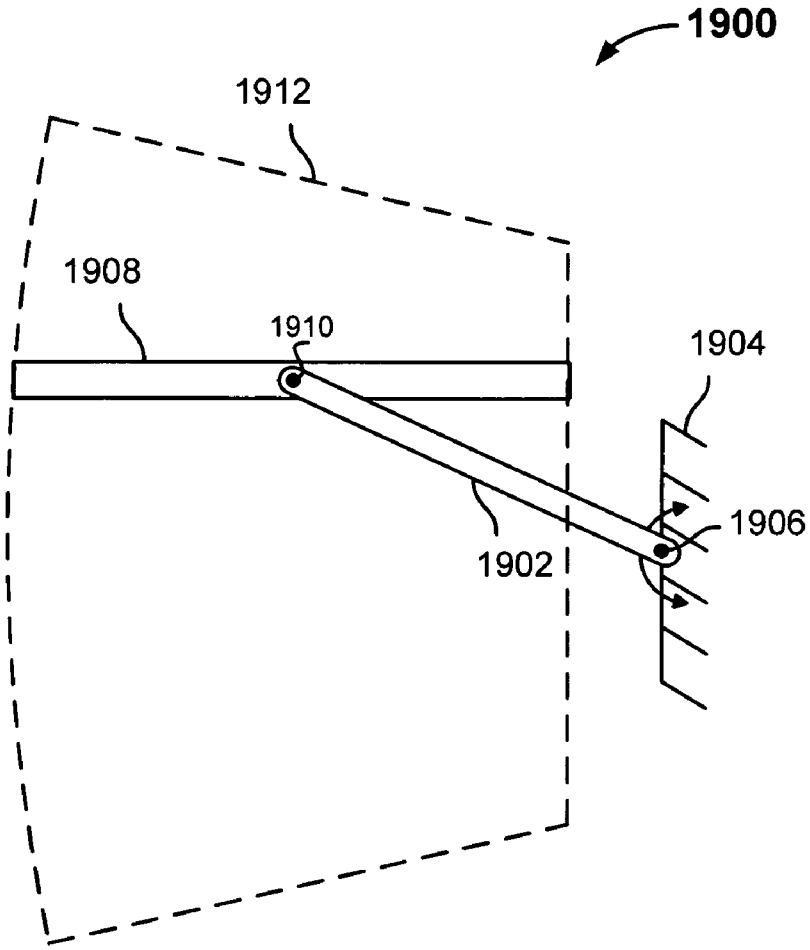
FIG. 19 illustrates an embodiment of a compound paddle.

FIG. 19 illustrates an embodiment of a compound paddle 1900 that includes two components: component 1902 fixed to location 1904 and configured to rotate at least partially about axis of rotation 1906 and component 1908 coupled to component 1902 at anchor point 1910. In some embodiments, pixel elements are only installed on component 1908. The motion of component 1908 is imparted by the rotational motion of component 1902 about axis of rotation 1906 and results in sweep area 1912 of component 1908. As depicted, the configuration of compound paddle 1900 results in a nearly translational motion for component 1908 and thus a nearly rectangular sweep area 1912. In some embodiments, compound paddle 1900 is configured in a manner similar to a windshield wiper.

Figure 20A:
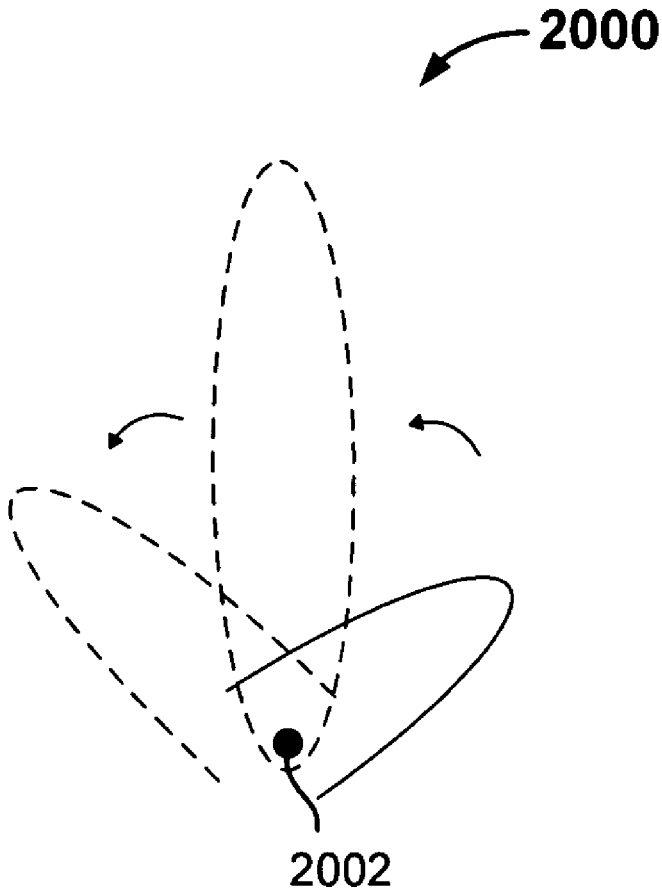
FIG. 20A illustrates an embodiment of a paddle.

In some embodiments, the size and/or shape of a paddle (or a component of a compound paddle) may be configured to be variable, for example, with angular position. FIG. 20A illustrates an embodiment of a paddle 2000 configured to rotate about axis of rotation 2002 whose size (i.e. length) changes with angular position.

Although some examples of paddle configurations have been described, any appropriate paddle configuration may be employed to obtain a desired sweep area and/or display shape. Pixel elements may be installed on paddles and/or paddle components in any appropriate configuration. In some embodiments, the pixels elements may comprise color LEDs, such as red, green, and blue LEDs and/or tri-color RGB LEDs.

Figure 20B:
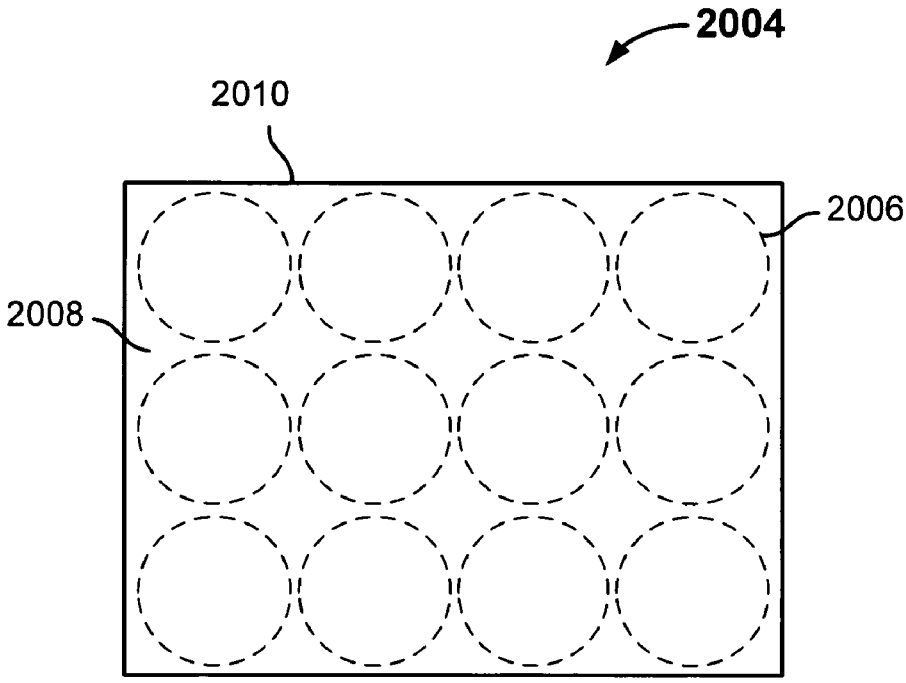
FIG. 20B illustrates an embodiment of a composite display.

FIG. 20B illustrates an embodiment of a composite display 2004. As depicted, composite display 2004 includes an array of paddles that have non-overlapping circular or disc-shaped sweep areas, such as sweep area 2006. Sweep area 2006 corresponds to the sweep area of a paddle, such as, for example, paddle 202 of FIG. 2A or paddle 1300 of FIG. 13. In some embodiments, the inter-disc area 2008 of composite display 2004 is filled with direct mount pixel elements, i.e. pixel elements that are fixed in place rather than on a rotating paddle. For example, the direct mount area 2008 may comprise one or more filler PCBs that are stationary and fabricated to align with the boundaries of the disc-shaped sweep areas 2006 of composite display 2004 that are associated with rotating paddles. In some embodiments, direct mount area 2008 and/or one or more parts of direct mount area 2008 are in a different plane (i.e. out-of-plane) relative to the paddles (which may all be in the same plane) that produce the disc-shaped sweep areas 2006 to ensure that there is some overlap (i.e., no gaps) in the display area 2010 of composite display 2004 and to ensure that there is no mechanical interference with the paddles. Although composite display 2004 is depicted to have a rectangular shaped display area 2010 in FIG. 20B, in other embodiments, the paddles and/or direct mount areas of a composite display may have any appropriate sizes and shapes to form a display area of a desired size and shape. In various embodiments, one or more direct mount areas may be installed in a composite display comprised of paddles with overlapping and/or non-overlapping sweep areas, for example, to obtain a desired display area shape.

As previously described, in some embodiments, pixel elements are placed on a paddle to provide redundancy of temporal pixels (e.g., more than one pixel element is placed at the same radius). Having more pixel elements per temporal pixel means that the rotation speed of the paddle can be reduced. The size of a paddle and the number and placement of pixel elements on the paddle can be selected to achieve a desired target rotational rate of the paddle. For example, for the paddle configuration of FIG. 11, the rotational rate scales inversely with the number of spokes of pixel elements installed on the paddle, i.e., a larger number of spokes allows a lower rotational rate for a given resolution.

Figure 21A:
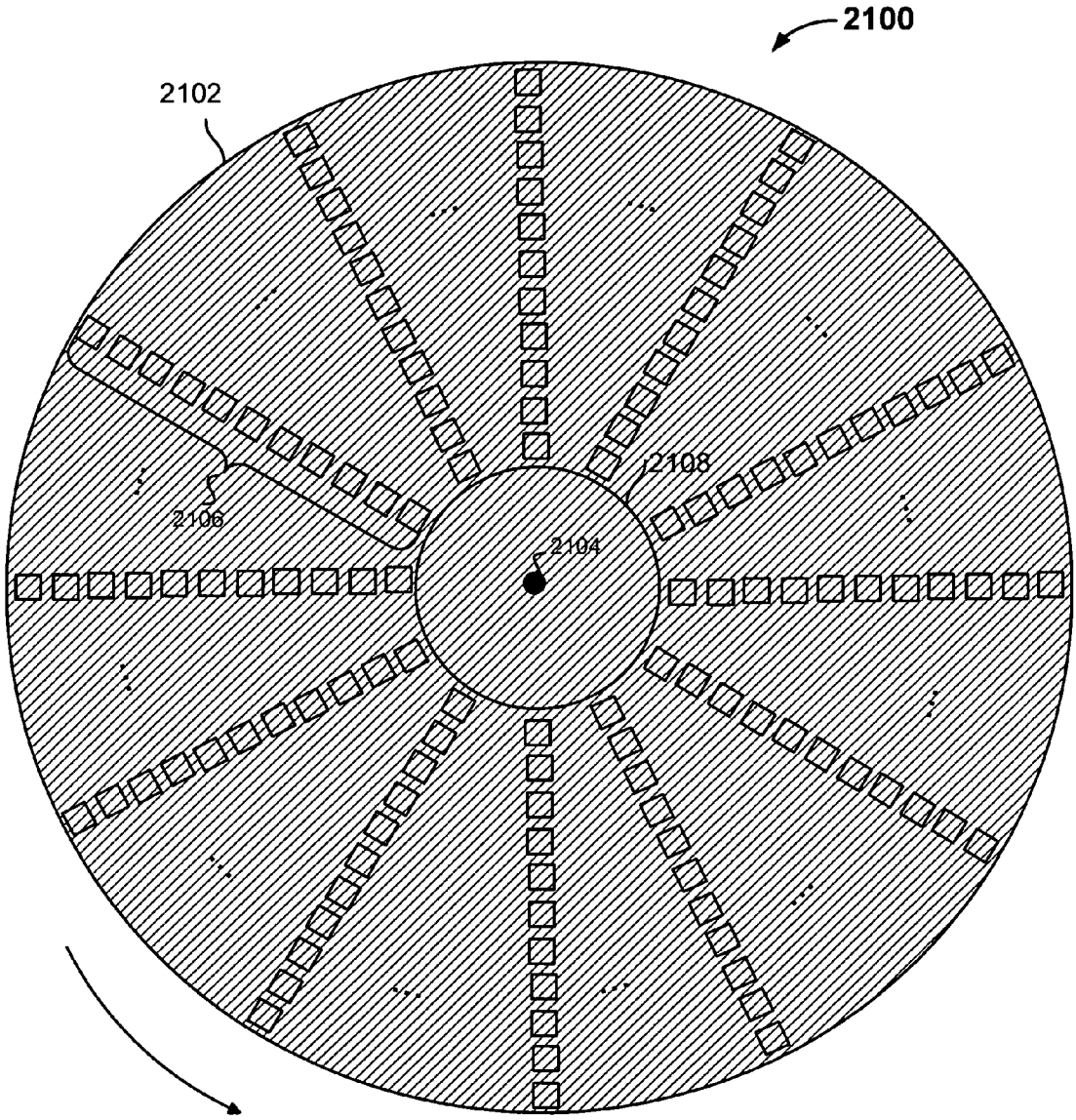
FIG. 21A illustrates an embodiment of a composite display.

FIG. 21A illustrates an embodiment of a composite display 2100 comprised of a single paddle 2102 that is large enough and that is populated with enough pixel elements that video display is possible with a relatively low rotational rate of the paddle. As depicted, paddle 2102 comprises a disc configured to rotate about axis of rotation 2104. Pixel elements are radially installed on paddle 2102 along a plurality of spokes or arrays, such as spoke 2106. For example, for a color display, each spoke may comprise an array of red, green, or blue LEDs. In some embodiments, because of the large number of spokes of pixel elements installed on paddle 2102 and the physical size of each pixel element, there may not be enough room to extend the spokes all the way to the center of paddle 2102 where all of the spokes would meet. In some such cases, paddle 2102 may include an empty center portion 2108 where no pixel elements are installed as shown in FIG. 21A. Alternatively, paddle 2102 may include a center portion 2108 in which pixels elements are installed (not shown in FIG. 21A). In such a case, data correction may be performed where applicable for pixel elements included within center portion 2108. For example, a separate image pixel to temporal pixel mapping may be employed for center portion 2108. In some embodiments, center portion 2108 does not rotate.

In some embodiments, each spoke of paddle 2102 is updated with new data every fractional rotation of paddle 2102. In one embodiment of paddle 2102, for example, paddle 2102 has a 7 foot diameter, pixel elements are mounted along 60 spokes or radii of paddle 2102, and paddle 2102 rotates at a rate of 1 Hz. In this embodiment, each spoke of pixel elements is updated every $1/60^{th}$ of a second so that 60 Hz video is displayed with the paddle rotating at a rate of 1 Hz. Thus, if a paddle is large enough and populated with enough pixel elements, it can be rotated at a relatively low rotational rate (e.g., less than or equal to 2 Hz) to achieve video speeds because each splice of a frame is being locally rendered by a spoke and updated every fractional turn of the paddle. In other embodiments, paddle 2102 may be employed to display one or more static images.

Figure 21B:
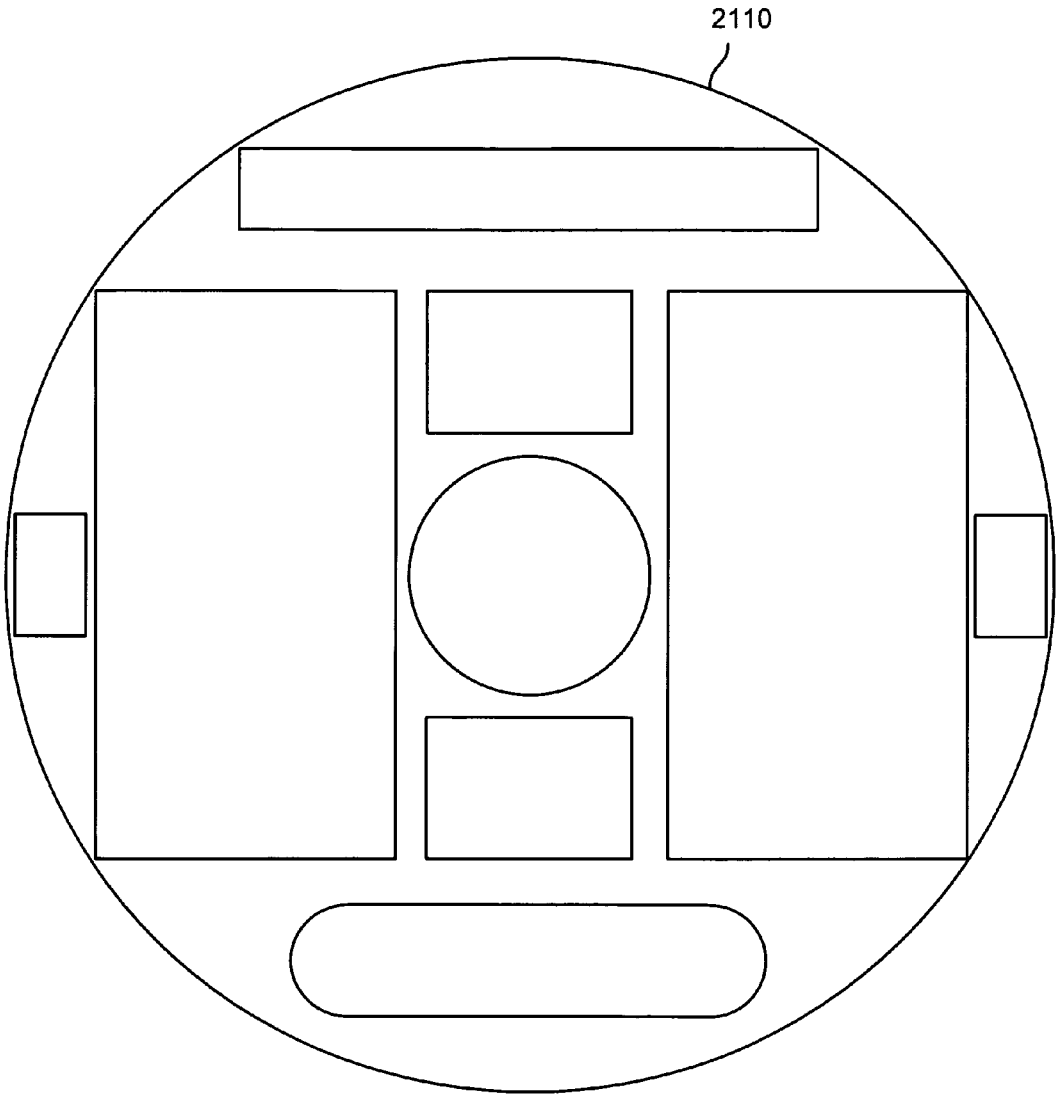
FIG. 21B illustrates an embodiment of a display area.

The display area of composite display 2100 may have any shape. As depicted in FIG. 21B, display area 2110 coinciding with the sweep area of paddle 2102 comprises the maximum display area. One or more smaller display areas may be included within the maximum display area 2110 as shown. The shapes and sizes of such smaller display areas within the maximum display area 2110 are reconfigurable as desired.

In some embodiments, displaying splices of an image or frame using rotating (or otherwise moving) arrays of pixel elements eliminates the need to calibrate pixel elements. For example, in many cases, a burnt out pixel element is not visible to the eye because that pixel element contributes only a small portion of the content. That is, the same spatial area of a display is rendered by pixel elements on different spokes as the paddle rotates or otherwise moves. For instance, with respect to the aforementioned example of a paddle having 60 spokes that is rotating at 1 Hz and displaying video at a 60 Hz refresh rate, a burnt out pixel element would contribute to the same spatial area of the display in one out of every 60 frames.

Figure 22A:
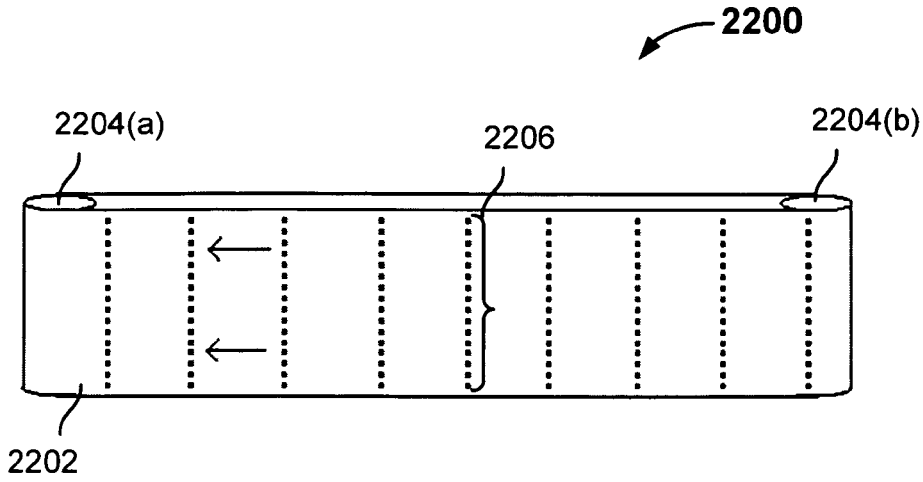
FIG. 22A illustrates an embodiment of a composite display.
Figure 22B:
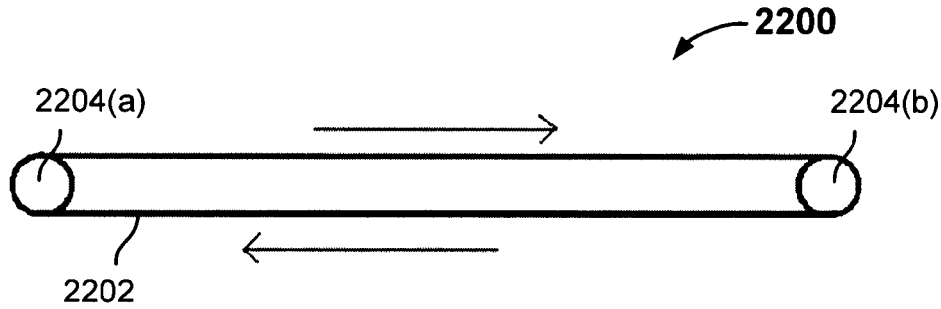
FIG. 22B illustrates an embodiment of a composite display.

FIG. 22A and FIG. 22B illustrate an embodiment of a composite display 2200 comprising a paddle 2202 in the shape of a belt configured to loop around rollers 2204. FIG. 22A illustrates a viewer's perspective of composite display 2200 and FIG. 22B illustrates a view of composite display 2200 looking down from the top that shows paddle 2202 rotating around rollers 2204 in a closed loop in a manner similar to a conveyor belt. In some embodiments, paddle 2202 comprises a flexible PCB board onto which arrays, such as array 2206, of pixel elements are installed. In the cases in which paddle 2202 includes a sufficient number of pixel element arrays, an image or a frame of video data is displayed for each fractional rotation of paddle 2202 about rollers 2204. In such cases, video may be displayed for relatively slow rotational rates of paddle 2202 about rollers 2204 in a manner similar to that described above with respect to FIG. 21A. For a color display, each array of pixel elements may comprise an array of red, green, or blue LEDs. The arrays of pixel elements sweep out a rectilinear array of temporal pixels in composite display 2200. In some cases because of the rectilinear array of temporal pixels, no degenerate pixels exist in composite display 2200 and/or there is no need for luminance balancing. In some embodiments, a large scale version of composite display 2200 can be wrapped around a building or another structure. The maximum display area of composite display 2200 is the same as the outside surface area of paddle or belt 2202.

Although some examples have been described, in other embodiments, any other appropriate paddle configurations that have relatively low rotational rates while still producing video speeds by updating frames of the video data every fractional rotation of the paddle through its associated sweep area may be employed. In various embodiments, such a paddle configuration may comprise a single monolithic paddle forming a composite display or may comprise a plurality of tiled paddles forming a composite display. In some embodiments, such paddle configurations may be employed to display one or more static images.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A composite display, comprising:

a compound paddle including a plurality of components and configured to sweep out an area, wherein the plurality of components includes a first component configured for rotating about a first axis of rotation, the first component coupled to a second component having a second axis of rotation;

a plurality of pixel elements mounted on the first and second components; and a control module configured for selectively activating one or more of the plurality of pixel elements while the compound paddle sweeps the area, causing at least a portion of an image to be rendered.

2. The composite display of claim 1, wherein at least one component of the plurality of components is associated with an axis of motion.

3. The composite display of claim 1, wherein one or more components of the plurality of components impart motion to one or more other components of the plurality of components.

4. The composite display of claim 1, wherein the second component is configured for rotating about the second axis of rotation.

5. The composite display of claim 1, wherein the first component is larger than the second component.

6. The composite display of claim 1, wherein the first component is smaller than the second component.

7. The composite display of claim 1, wherein pixel elements are mounted on both the first component and the second component.

8. The composite display of claim 1, wherein the first component is configured to provide rotary motion which is at least in part converted into translational motion for the second component by a coupling of the second component to the first component via a third component.

9. The composite display of claim 1, wherein the plurality of pixel elements are mounted on the second component.

10. The composite display of claim 1, wherein the sweep area includes a sector-like area.

11. The composite display of claim 1, wherein the first component is configured to impart motion to the second component.

12. The composite display of claim 11, wherein the plurality of pixel elements are mounted on the second component.

13. The composite display of claim 11, wherein the sweep area is nearly rectangular.

14. The composite display of claim 1, wherein at least one pixel element includes a light emitting diode (LED).

15. A method, comprising:

sweeping out an area with a compound paddle by rotating a first paddle about a first axis of rotation, the rotating causing motion to be imparted to a second paddle having a second axis of rotation; and selectively activating one or more of a plurality of pixel elements disposed on the first paddle and the second paddle while the compound paddle sweeps the area, causing at least a portion of an image to be rendered.

16. A composite display, comprising:

a paddle configured to sweep out an area as the paddle rotates through angular positions about an axis; and a plurality of pixel elements mounted on the paddle;

wherein one or more of a size and a shape of the paddle varies based on the angular position of the paddle and wherein selectively activating one or more of the plurality of pixel elements while the paddle sweeps the area causes at least a portion of an image to be rendered.

17. The composite display of claim 16, wherein the paddle includes a component of a compound paddle having a plurality of components.

18. A composite display, comprising:

an array of paddles, wherein each paddle in the array is configured to rotate about an axis to sweep an area, each paddle including a plurality of pixel elements;

a control module configured for selectively activating one or more of the plurality of pixel elements of each paddle while the paddle sweeps its associated area; and one or more direct mount areas installed between the sweep areas of the array of paddles, wherein each direct mount area includes pixel elements that are fixed in place, wherein the control module is configured to control both the pixel elements of the paddles and the pixel elements that are fixed in place to cause at least a portion of an image to be rendered in the composite display.

19. The composite display of claim 18, wherein sweep areas of one or more paddles in the array do not overlap.

20. The composite display of claim 18, wherein sweep areas of one or more paddles in the array overlap.

21. The composite display of claim 18, wherein each direct mount area includes a stationary printed circuit board (PCB).

22. The composite display of claim 18, wherein one or more of the direct mount areas are in a different plane than the array of paddles.

23. The method of claim 15, wherein the rotating imparts a rotary motion to the second paddle.

24. An apparatus, comprising:

means for sweeping out an area with a compound paddle by rotating a first paddle about a first axis of rotation, the rotating causing motion to be imparted to a second paddle having a second axis of rotation; and means for causing at least a portion of an image to be rendered by selectively activating one or more of a plurality of pixel elements disposed on the first paddle and the second paddle while the compound paddle sweeps the area.

25. The apparatus of claim 24, wherein the sweeping means includes means for imparting a rotary motion to the second paddle.

* * * * *